United States Patent [19]

Ishikawa et al.

[11] Patent Number: 4,845,016

[45] Date of Patent: Jul. 4, 1989

[54] PROCESS FOR PROCESSING SILVER HALIDE COLOR PHOTOGRAPHIC MATERIALS USING A MULTISTAGE COUNTERFLOW STABILIZATION SYSTEM

[75] Inventors: Takatoshi Ishikawa; Nobuo Sakai, both of Kanagawa, Japan

[73] Assignee: Fuji Photo Film Co., Ltd., Japan

[21] Appl. No.: 8,506

[22] Filed: Jan. 29, 1987

[30] Foreign Application Priority Data

Jan. 29, 1986 [JP] Japan ..... 61-18754

[51] Int. Cl.[4] ..... G03C 7/30; G03C 5/24; G03C 7/32

[52] U.S. Cl. ..... 430/372; 450/380; 450/377; 450/464; 450/376; 450/467; 450/469; 450/558

[58] Field of Search ..... 430/372, 377, 464, 467, 430/469, 376, 380, 558

[56] References Cited

U.S. PATENT DOCUMENTS

| | | | |
|---|---|---|---|
| 3,996,054 | 12/1976 | Santemma et al. | 430/377 |
| 4,035,188 | 7/1977 | Tabata et al. | 430/467 |
| 4,299,914 | 11/1981 | Fujumastu et al. | 430/552 |
| 4,304,844 | 12/1981 | Fujumastu et al. | 430/552 |
| 4,336,324 | 6/1982 | Koboshi et al. | 430/421 |
| 4,443,536 | 4/1984 | Lestina | 430/552 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,565,777 | 1/1986 | Ogawa et al. | 430/552 |
| 4,618,573 | 10/1986 | Okamura et al. | 430/558 |

FOREIGN PATENT DOCUMENTS

| | | | |
|---|---|---|---|
| 211437 | 2/1987 | European Pat. Off. . | |
| 19140 | 1/1935 | Japan . | |
| 29461 | 8/1974 | Japan . | |
| 52058 | 4/1980 | Japan . | |
| 200037 | 12/1982 | Japan . | |
| 31334 | 2/1983 | Japan . | |
| 42045 | 3/1983 | Japan . | |
| 50536 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 26338 | 2/1985 | Japan . | |
| 26339 | 2/1985 | Japan . | |
| 158444 | 8/1985 | Japan . | |
| 158446 | 8/1985 | Japan | 430/464 |
| 162256 | 8/1985 | Japan . | |
| 172042 | 9/1985 | Japan . | |
| 70552 | 4/1986 | Japan . | |
| 30250 | 2/1987 | Japan . | |

*Primary Examiner*—Paul R. Michl
*Assistant Examiner*—Patrick Doody
*Attorney, Agent, or Firm*—Sughrue, Mion, Zinn, Macpeak & Seas

[57] ABSTRACT

A process for processing a silver halide color photographic material is described, which comprises processing by treatment with a color developer containing an aromatic primary amine developing agent but substantially free from benzyl alcohol, for a time shorter than 2 min and 30 sec, a silver halide color photographic material having on a support at least one photograph-constituting layer containing a compound represented by formula (I)

(I)

wherein $R_0$ represents a substituted or unsubstituted aryl group; $R_1$, $R_2$, $R_3$ and $R_4$ each represents a hydrogen atom, a substituted or unsubstituted alkyl group, or a substituted or unsubstituted aryl group; and Z represents a hydrogen atom or a substituted or unsubstituted acetyl group.

19 Claims, No Drawings

PROCESS FOR PROCESSING SILVER HALIDE COLOR PHOTOGRAPHIC MATERIALS USING A MULTISTAGE COUNTERFLOW STABILIZATION SYSTEM

FIELD OF THE INVENTION

This invention relates to a process for processing silver halide color photographic materials, and more particularly, the invention relates to a processing process for color photographic materials including a very shortened color development time without using benzyl alcohol.

BACKGROUND OF THE INVENTION

Hitherto, various kinds of developing agent penetrants have been investigated for increasing the coloring property of color photographic light-sensitive materials and, in particular, a process of quickening color development by adding benzyl alcohol to a color developer has been widely used at present for the processing of color photographic materials because of accelerating a coloring effect, particularly color photographic papers.

However, in the case of using benzyl alcohol, diethylene glycol, triethylene glycol, alkanolamine, etc., must be used as the solvent therefor due to the low water solubility thereof. Since, however, the above-described compounds including benzyl alcohol have high BOD (biochemical oxygen demand) and COD (chemical oxygen demand) pollution leading values, it is preferred to avoid use of benzyl alcohol as much as possible.

Furthermore, even in the case of using the aforesaid solvent, it requires a long time to dissolve benzyl alcohol, and, hence, it is also better to avoid use of benzyl alcohol for the purpose of reducing the work load involved in preparing the solution of benzyl alcohol.

Also, when benzyl alcohol existing in a color developer is carried in a bleach bath or a blix (bleach-fix) bath which is a post-bath of the color developer, it causes the formation of the leuco dye of a cyan dye, which further causes the reduction of coloring density. Still further, when such benzyl alcohol exists in a bleaching solution or a blixing solution, it delays the washing out speed of developer components from color photographic materials, and, hence, it sometimes results in adverse influences on the stability or storability of color images of processed color photographic materials. Accordingly, it is also preferred to avoid use of benzyl alcohol for these reasons, also.

Color development is generally performed for about 3 to 4 minutes, but recently with the shortening of the time for delivering finished photographic products and the reduction of laboratory work, it has been desired to shorten the processing time for photographic materials.

On the other hand, when the development time for color photographic materials is shortened without using benzyl alcohol, which is a coloring accelerator, the coloring density is inevitably greatly reduced.

For solving the above-described problems, various color development accelerators have been described, for example, in U.S. Pat. Nos. 2,950,970, 2,515,147, 2,496,903, 2,304,925, 4,038,075, 4,119,462, British Pat. Nos. 1,430,998, 1,455,413, Japanese Patent Application (OPI) Nos. 15831/78, 62450/80, 62451/80, 62452/80, 62453/80, 50536/83 and 162256/85 (the term "OPI" as used herein refers to a "published unexamined Japanese patent application"), Japanese Patent Publication Nos. 12422/76, 49728/80, etc. However, even by the use of these color development accelerators, a satisfactory coloring density has not yet been obtained.

Also, methods for incorporating color developing agents in color photographic materials are proposed as described, for example, in U.S. Pat. Nos. 3,719,492, 3,342,559, 3,342,597, Japanese Patent Application (OPI) Nos. 6235/81, 16133/81, 97531/82, 83565/82, etc., but these methods have disadvantages in that the color development is delayed and the formation of fog is increased, and, thus, are not proper methods.

Furthermore, a method of using a silver chloride emulsion as described, for example, in Japanese Patent Application (OPI) Nos. 95345/83, 232342/84, 19140/85, etc., may shorten the color development time but the formation of fog is likely to increase.

As described above, a method of obtaining color images having satisfactory quality in a shortened time using a color developer containing substantially no benzyl alcohol has not yet been found.

On the other hand, methods of accelerating color development by incorporating pyrazolidone compounds in silver halide color photographic materials are described in Japanese Patent Application (OPI) Nos. 144547/82, 146236/85, 50532/83, 115438/83, 158444/85, 26339/85, 158445/85, 165651/85, etc. Also, a counterplan for reducing the concentration of benzyl alcohol in color developer is proposed in Japanese Patent Application (OPI) Nos. 50536/83 and 158446/85.

However, when the proposals described above are employed under the condition of shortening a color development time using a color developer substantially free from benzyl alcohol, the coloring property of, in particular, magenta dye, is reduced, and a satisfactory result has not been obtained.

SUMMARY OF THE INVENTION

The object of this invention is, therefore, to provide a process for processing silver halide color photographic materials giving a satisfactory coloring property even in shortened processing wherein the color development time is at most 2 min. and 30 sec. using a color developer substantially free from benzyl alcohol.

As the result of extensive investigations, the inventors have discovered that the aforesaid object can be attained by the invention as described hereinbelow.

That is, according to this invention, there is provided a process for processing a color photographic material, which comprises processing by treatment with a color developer containing an aromatic primary amine developing agent but substantially free from benzyl alcohol for a time shorter than 2 min. and 30 sec. a silver halide color photographic material having on a support at least one photograph-constituting layer containing a compound represented by formula (I)

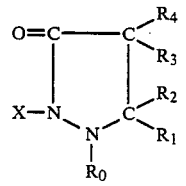

(I)

wherein $R_0$ represents a substituted or unsubstituted aryl group; $R_1$, $R_2$, $R_3$ and $R_4$ each represents a hydrogen atom, a substituted or unsubstituted alkyl group, or a substituted or unsubstituted aryl group; and X represents a hydrogen atom or a substituted or unsubstituted acetyl group.

In this invention, it is preferred that the silver halide color photographic material described above contains a magenta coupler represented by formula (II)

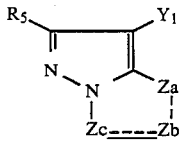

(II)

wherein $R_5$ represents a hydrogen atom or a substituent; $Y_1$ represents a group capable of being released by a coupling reaction with the oxidation product of an aromatic primary amine developing agent; and Za, Zb and Zc each represents a substituted or unsubstituted methine group, =N—, or —NH—; at least one of said Za—Zb bond and said Zb—Zc bond being a double bond and the other being a single bond.

DETAILED DESCRIPTION OF THE INVENTION

The invention is described below in further detail.

First, the compound represented by formula (I) is described in further detail.

X in formula (I) represents a hydrogen atom or an acetyl group which may be substituted by an alkyl group (e.g., a methyl group, an ethyl group, etc.), etc., but is preferably a hydrogen atom.

The aryl group shown by $R_0$ in formula (I) includes a phenyl group, a naphthyl group, a tolyl group, a xylyl group, etc., and is particularly preferably a phenyl group. The aryl group may be substituted by a halogen atom (e.g., a chlorine atom, a bromine atom, etc.), an alkyl group (e.g., a methyl group, an ethyl group, a propyl group, etc.), an alkoxy group (a methoxy group, an ethoxy group, etc.), a sulfonyl group, an amido group (e.g., a methylamido group, an ethylamido group, etc.), etc.

The alkyl group shown by $R_1$, $R_2$, $R_3$ and $R_4$ in formula (I) is preferably an alkyl group having from 1 to 10 carbon atoms (e.g., a methyl group, an ethyl group, a propyl group, a butyl group, etc.) and the alkyl group may be substituted by a hydroxyl group, an amino group, an acyloxy group, etc. Also, the aryl group shown by $R_1$, $R_2$, $R_3$ and $R_4$ includes a phenyl group, a naphthyl group, a xylyl group, a tolyl group, etc., but is particularly preferably a phenyl group. The aryl group may be substituted by a halogen atom (e.g., a chlorine atom, a bromine atom, etc.), an alkyl group (e.g., a methyl group, an ethyl group, a propyl group, etc.), an alkoxy group (e.g., a hydroxyl group, a methoxy group, an ethoxy group, etc.), etc.

In this invention, $R_1$, $R_2$, $R_3$ and $R_4$ are preferably an aryl group and an acyloxy group-substituted alkyl group, and more preferably a substituted or unsubstituted phenyl group. The compound of formula (I) wherein $R_1$ or $R_2$ is a phenyl group and the compound of formula (I) wherein $R_3$ or $R_4$ is an alkyl group substituted by an acyloxy group are particularly preferred in this invention.

Specific examples of the compound represented by formula (I) described above are illustrated below but the compounds for use in this invention are not limited thereby.

I-1

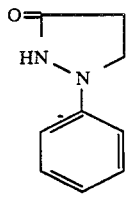

I-2

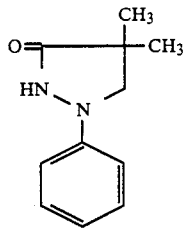

I-3

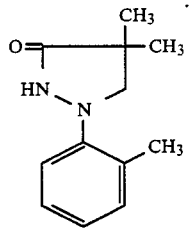

I-4

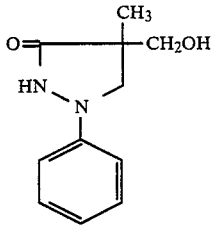

I-5

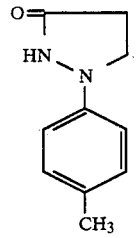

I-6

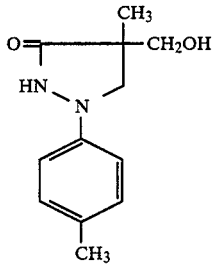

-continued
I-7
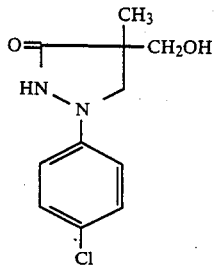
I-8
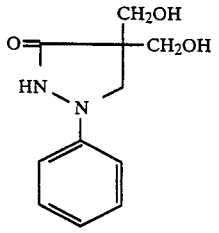
I-9
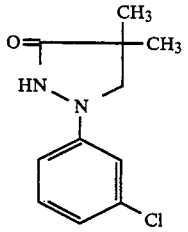
I-10
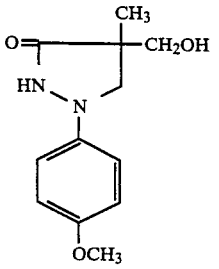
I-11
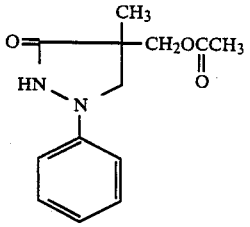
I-12
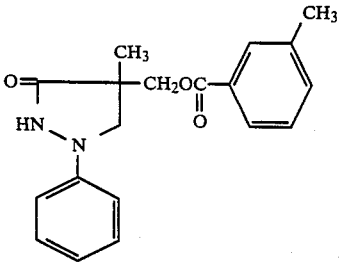
-continued
I-13
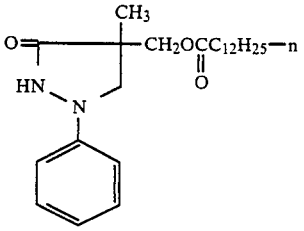
I-14
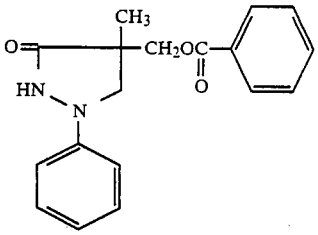
I-15
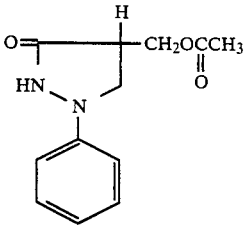
I-16
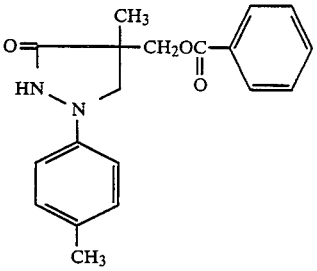
I-17
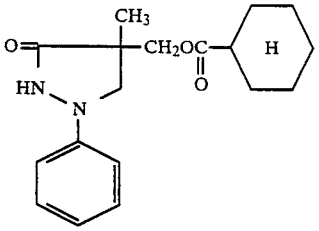
I-18
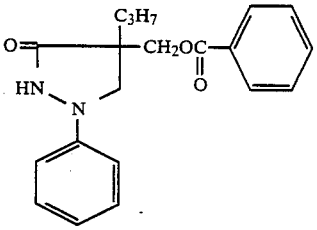

-continued
I-19
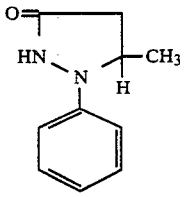
I-20
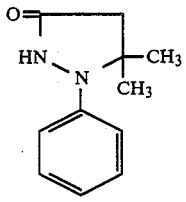
I-21
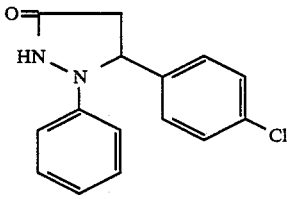
I-22
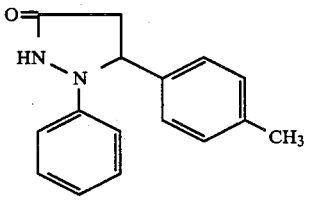
I-23
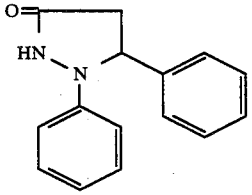
I-24
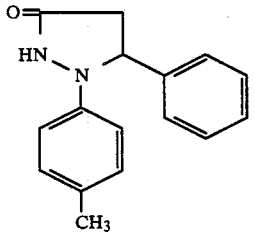
I-25
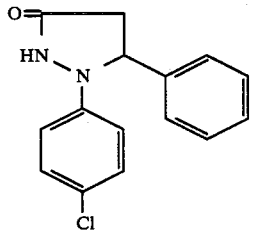
-continued
I-26
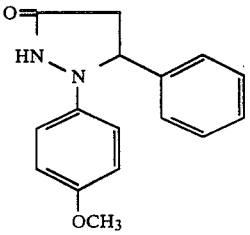
I-27
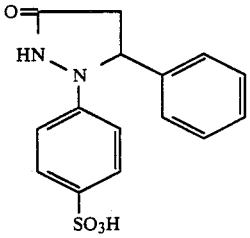
I-28
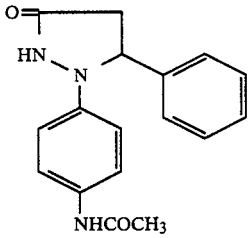
I-29
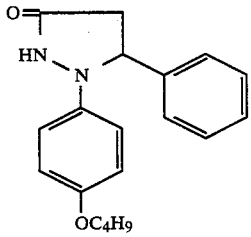
I-30
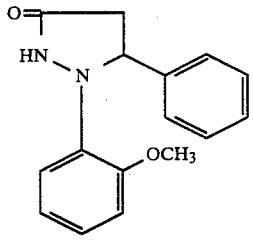
I-31
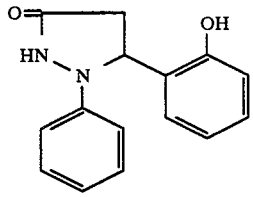
I-32
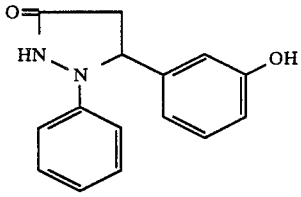

-continued
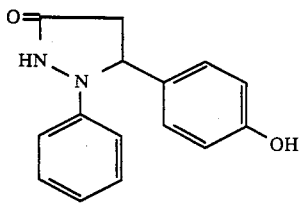
I-33
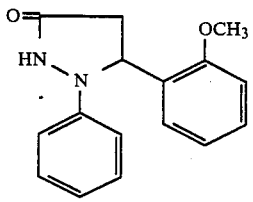
I-34
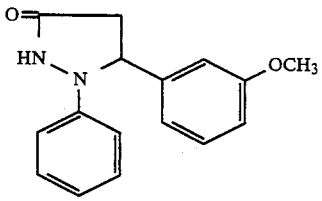
I-35
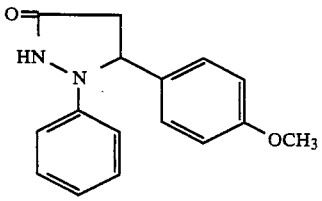
I-36
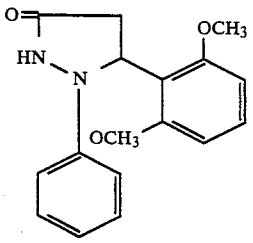
I-37
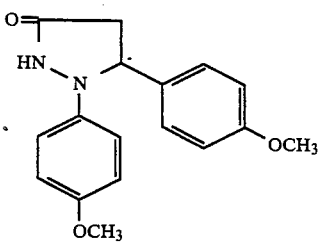
I-38
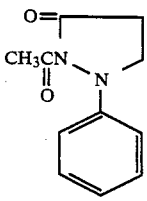
I-39
-continued
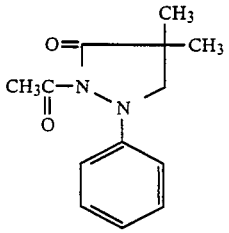
I-40
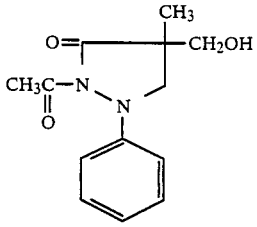
I-41
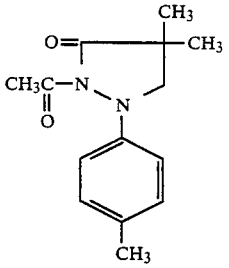
I-42
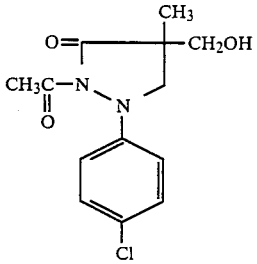
I-43
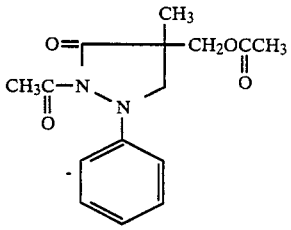
I-44
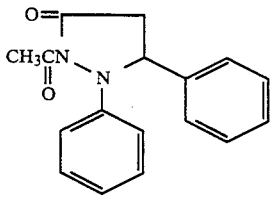
I-45

-continued

I-46

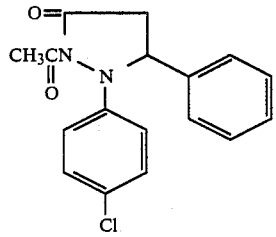

In the compounds illustrated above, Compounds I-11 to I-18, I-21 to I-38, and I-44 to I-46 are preferred in this invention.

Some of the compounds represented by formula (I) described above may be commercially available but all the compounds of formula (I) can be easily synthesized according to the methods described in U.S. Pat. Nos. 2,688,024, 2,704,762 and Japanese Patent Application (OPI) No. 64339/81.

Synthesis examples of the typical compounds of formula (I) are shown below.

SYNTHESIS EXAMPLE 1

Synthesis of Compound I-12

To 41.2 g of 4-hydroxymethyl-4-methyl-1-phenyl-3-pyrazolidone was added 300 ml of acetonitrile contained in a 1 l-four neck flask. The inside temperature of the flask was kept at 10° C. while cooling with an outer bath with ice water, 31.0 g of benzoyl chloride was added dropwise to the mixture gradually while stirring the mixture under nitrogen gas stream over a period of 30 minutes. Thereafter, the outer bath was remove, the resultant mixture was stirred for 3 hours and then allowed to stand a whole day and night in a nitrogen gas atmosphere. The reaction mixture thus obtained was concentrated and dried, and then dissolved in ethyl acetate. The solution obtained was washed with an aqueous solution of 3 wt % sodium hydrogencarbonate ($NaHCO_3$), and then with water and the ethyl acetate layer formed was collected, dried by Glauber's salt, concentrated, dried into solid, crystallized with a mixed solvent of methanol and water, and then further recrystallized from a mixed solvent of n-hexane and ethyl acetate to provide 10.5 g of a product. The compound thus obtained was confirmed to have the desired structure by the results of the NMR (Nuclear Magnetic Resonance) measurement, the TR (Temperature Recorder) measurement, and the elemental analysis thereof.

SYNTHESIS EXAMPLE 2

Synthesis of Compound I-24

A mixture of 22.5 g of the hydrochloride of 4-methylphenylhydrazine, 1.5 g of tert-butylhydroquinone, 67.5 ml of methanol containing 28 wt % sodium methoxide, and 250 ml of n-butanol was heated with stirring under a nitrogen gas stream to distill off methanol, and then after adding dropwise thereto 29.6 g of ethyl cinnamate over a period of 30 minutes, the resultant mixture was heated with stirring for 2 hours while distilling of n-butanol at normal pressure. The reaction mixture obtained was cooled, neutralized with an aqueous hydrochloric acid solution, and extracted with ethyl acetate. The ethyl acetate extract was collected, washed with water, and dried by anhydrous magnesium sulfate. After distilling of the solvent from the extract, the residue was crystallized with ethyl acetate to provide 7.7 g of Compound I-24. Melting Point: 156 to 158° C.

The results of the elemental analysis were as follows.

| Elemental Analysis for $C_{16}H_{16}N_2O$: | C | H | N |
|---|---|---|---|
| Calculated (%): | 76.17 | 6.39 | 11.10 |
| Found (%): | 76.20 | 6.19 | 11.07 |

SYNTHESIS EXAMPLE 3

Synthesis of Compound I-32

A mixture of 18 g of phenylhydrazine, 1.0 g of tert-butylhydroquinone, 50.2 ml of a methanol solution containing 28 wt % sodium methoxide, and 250 ml of n-butanol was heated with stirring under nitrogen gas stream to distill off methanol and then 100 ml of an n-butanol solution of 32 g of ethyl m-hydroxycinnamate was added dropwise to the mixture over a period of 30 minutes. Then, after heating the reaction mixture with stirring for 3 hours while distilling off n-butanol at normal pressure, the reaction mixture was cooled, neutralized with an aqueous hydrochloric acid solution, and extracted with n-butanol. The extract thus obtained was washed with a saturated aqueous sodium chloride solution, dried by anhydrous magnesium sulfate, and then the solvent was distilled off. The residue formed was recrystallized from a mixed solvent of methanol and n-hexane (the volume ratio: 2/1) to provide 14.1 g of Compound I-32. Melting Point: 188° C. to 189.5° C.

The results of the elemental analysis were as follows.

| Elemental Analysis for $C_{15}H_{14}N_2O_2$: | C | H | N |
|---|---|---|---|
| Calculated (%): | 70.85 | 5.55 | 11.01 |
| Found (%): | 70.84 | 5.43 | 11.17 |

Synthesis Example 4

Synthesis of Compound I-35

A mixture of 19.4 g of phenylhydrazine, 1.6 g of tert-butylhydroquinone, 60.3 ml of a methanol solution containing 28 wt % sodium methoxide, and 250 ml of n-butanol was heated with stirring under nitrogen gas stream to distill off methanol and then 100 ml of an n-butanol solution of 41.2 g of ethyl m-methoxycinnamate was added dropwise to the mixture over a period of 30 minutes. The reaction mixture thus obtained was heated with stirring for 1 hour while distilling of n-butanol at normal pressure, cooled, neutralized with an aqueous hydrochloric acid solution, and extracted with n-butanol. The extract thus obtained was washed with a saturated aqueous sodium chloride solution, dried by anhydrous magnesium sulfate, and the solvent was distilled off. The solid thus formed was recrystallized from methanol to provide 30 g of Compound I-35. Melting Point: 164° C. to 166° C.

The results of the elemental analysis of the product were as follows.

| Elemental Analysis for $C_{16}H_{16}N_2O_2$: | | | |
|---|---|---|---|
| | C | H | N |
| Calculated (%): | 71.62 | 6.01 | 10.44 |
| Found (%): | 71.61 | 5.95 | 10.56 |

The addition amount of the compound represented by formula (I) described above is generally from 0.001 mol to 1 mol, and preferably from 0.005 mol to 0.5 mol, per mol of silver halide contained in the silver halide emulsion layer. The compound of formula (I) may be incorporated in each of silver halide emulsion layers (a blue-sensitive emulsion layer, a green-sensitive emulsion layer, and a red-sensitive emulsion layer) or may be incorporated in the whole emulsion layers. Furthermore, the compound may be incorporated in a layer adjacent to a silver halide emulsion layer. For incorporating the compound of formula (I) in the aforesaid layer(s) (i.e., the above layers are referred to as "photograph-constituting layers), it is preferred to directly add the compound to a silver halide emulsion or a gelatin solution, or to dissolve the compound in water or an alcohol and then disperse the solution in a silver halide emulsion or a gelatin solution. Moreover, the compound of formula (I) may be dissolved out from the color photographic material in a color developer during processing to function the development accelerating effect.

In the preferred embodiment of this invention, the color photographic light-sensitive material to be processed contains therein the magenta coupler represented by formula (II) as described hereinbefore. The magenta couplers of formula (II) are, then, described below in detail.

In formula (II), $R_5$ represents a hydrogen atom or a substituent; $Y_1$ represents a hydrogen atom or a group capable of being released by a coupling reaction with the oxidation product of an aromatic primary amine developing agent; and Za, Zb and Zc each represents a substituted or unsubstituted methine group, =N— or —NH—; one of the Za—Zb bond and the Zb—Zc bond being a double bond and the other being a single bond.

When the Zb—Zc bond is a carbon-carbon double bond, the double bond (Zb=Zc) may be a part of an aromatic ring. Also, the magenta coupler of formula (II) includes the case of forming a dimer or higher polymer at $R_5$ or $Y_1$. Furthermore, when Za, Zb or Zc is a substituted methine, the compound of formula (II) includes the case of forming a dimer or higher polymer at the substituted methine.

A polymer as the compound represented by formula (II) means a compound having two or more moieties shown by formula (II) in 1 molecule and includes a bis compound and a polymeric coupler. The polymeric coupler may be a homopolymer composed of only of the monomer (preferably having a vinyl group, the monomer having a vinyl group is hereinafter referred to as a vinyl monomer) having the moiety shown by formula (II), or may be a copolymer composed of the above-described monomer and a non-coloring ethylenically unsaturated monomer which does not cause a coupling reaction with the oxidation product of an aromatic primary amine developing agent.

The magenta coupler represented by formula (II) is a nigrogen-containing 5-membered ring-condensed 5-membered ring type magenta coupler and the coloring mother nucleus thereof shows an aromaticity isoelectronic to naphthalene and has a chemical structure usually referred to as azapentalene.

Preferred examples of the magenta couplers represented by formula (II) include 1H-imidazo[1,2-b]-pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles, and 1H-pyrazolo[1,5-a]benzimidazoles represented by formulae (III), (IV), (V), (VI), (VII) and (VIII) shown below, respectively. In these couplers, preferred couplers are those represented by formulae (III), (V), and (VI).

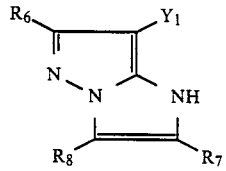
(III)

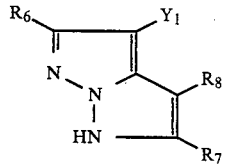
(IV)

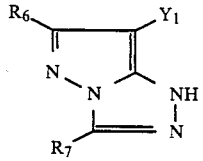
(V)

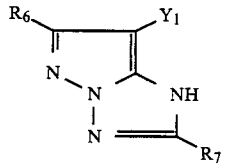
(VI)

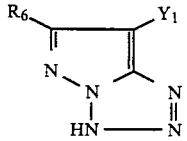
(VII)

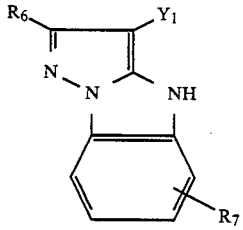
(VIII)

In formulae (III) to (VIII) described above, $R_6$, $R_7$ and $R_8$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and $Y_1$ represents a hydrogen atom, a halogen atom, a carboxy group, or a coupling releasable group capable of being released upon coupling by being bonded with the carbon atom at the coupling position of the coupler through an oxygen atom, a nitrogen atom, or a sulfur atom.

The magenta couplers represented by formulae (III) to (VIII) include the case that $R_6$, $R_7$, $R_8$ or $Y_1$ becomes a divalent group and each coupler forms a bis compound. Also, when a moiety represented by one of formulae (III) to (VIII) exists in the vinyl monomer, $R_6$, $R_7$ or $R_8$ represents a simple bond or a linkage group and the moiety shown by formulae (III) to (VIII) is bonded to a vinyl group through the bond or the connecting group.

In more detail, $R_6$, $R_7$ and $R_8$ each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbomoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)butyramido group, a γ-(3-t-butyl-4-hydroxyphenoxy)butyramido group, an α-[4-hydroxyphenylsulfonyl)phenoxy]decanamido group, etc.), an anilino group (e.g., a phenylanilino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxycarbonyl group, etc.).

Also, $Y_1$ in the above formulae represents a hydrogen atom, a halogen atom (e.g., a chlorine atom, a bromine atom, an iodine atom, etc.), a carboxyl group, a group being bonded by an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group being bonded by a nitrogen atom (e.g., a benzenesulfonamido group, an N-ethyltoluenesulfonamido group, a heptafluorobutanamido group, a 2,3,4,5,6-pentafluorobenzamido group, an octane-sulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5-bromobenzotriazol-1yl group, a 6-bromobenzotriazol-1-yl group, a 5-methyl-1,2,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group being bonded by a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_6$, $R_7$, $R_8$ or $Y_1$ in one of formulae (III) to (VIII) described above becomes a divalent group and the magenta coupler represented by formula (II) forms a bis-compound, the divalent group is explained below in more detail. That is, the divalent group includes a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

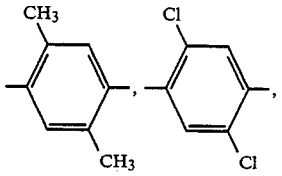

etc.), an $—NHCO—R_{10}—$ group (wherein $R_{10}$ represents a substituted or unsubstituted alkylene group or a substituted or unsubstituted phenylene group) or a —CONH— group.

The connecting group shown by $R_6$, $R_7$ or $R_8$ when the moiety shown by one of formulae (III) to (VIII) exists in a vinyl monomer as described above includes a group formed by combining the groups selected from substituted or unsubstituted alkylene groups (e.g., a methylene group, an ethylene group, a 1,10-decylene group, $—CH_2CH_2—O—CH_2CH_2—$, etc.), substituted or unsubstituted phenylene groups (e.g., a 1,4-phenylene group, a 1,3phenylene group,

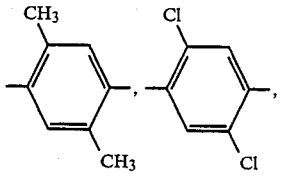

etc.), —NHCO—, —CONH—, —O—, —OCO—, and aralkylene groups (e.g.,

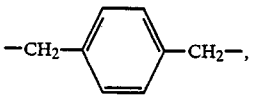

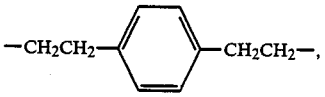

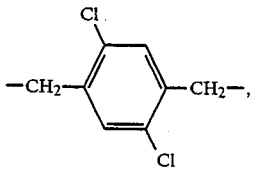

etc.).

In addition, the vinyl group in the vinyl monomer may further have other substituents in addition to the coupler moiety represented by formulae (III) to (VIII). Examples of the preferred substituent are a hydrogen atom, a chlorine atom, and a lower alkyl group having from 1 to 4 carbon atoms.

As the non-coloring ethylenically unsaturated monomer without coupling with the oxidation product of an aromatic primary amine developing agent, which forms the copolymer together with the vinyl monomer having the moiety represented by one of formulae (III) to (VIII), there are acrylic acid, α-chloroacrylic acid, α-aracrylic acid (e.g., methacrylic acid, etc.), the esters or amides induced from the aforesaid acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenebisacrylamide, vinyl esters (e.g., vinyl acetate, vinyl propionate, vinyl laurate, etc.), acrylonitrile, methacrylonitrile, aromatic vinyl compounds (e.g., styrene and the derivatives thereof, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), malic acid, maleic anhydride, a maleic acid ester, N-vinyl-2-pyrrolidone, N-vinylpyridine, 2-vinylpryidine, 4-vinylpyridine, etc.

The copolymer may have two or more of the noncoloring ethylenically unsaturated monomers.

Of the couplers of the formulae (III) to (VIII), the couplers of the formulae (III), (V) and (VI) are preferable and the coupler of the formula (VI) is the most preferable. In these formulae (V) and (VI), at least one of $R_6$ and $R_7$ is preferably a branched substituted or unsubstituted alkyl group, that is, an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamidoalkyl group, a sulfonamidoarylalkyl group, a sulfonylalkyl group and the like, wherein a sulfonamidoarylsulfonamidoalkyl group is preferable as a sulfonamidoalkyl group.

Examples and synthesis examples of the couplers represented by formulae (III) to (VIII) described above are described, e.g., in the literature noted below.

Compounds of formula (III) are described in Japanese Patent Application (OPI) No. 162548/84, compounds of formula (IV) are described in Japanese Patent Application (OPI) No. 43659/85, compounds of formula (V) are described in Japanese Patent Publication No. 27411/72, compounds of formula (VI) are described in Japanese Patent Application (OPI) Nos. 171956/84 and 172982/85, compounds of formula (VII) are described in Japanese Patent Application (OPI) No. 33552/85 and compounds of formula (VIII) are described in U.S. Pat. No. 3,061,432.

Also, the high coloring ballast groups described in Japanese Patent Application (OPI) Nos. 42045/83, 214854/84, 177553/84, 177554/84 and 177557/84 can be applied to the compounds of formulae (III) to (VIII) described above.
Specific examples of the pyrazoloazole series couplers of formula (II) described above are illustrated below, but the compounds for use in this invention are not limited thereby.
(M-1)
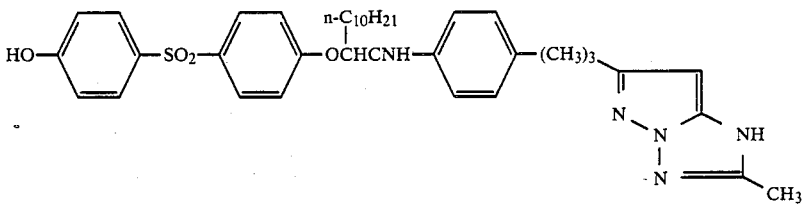
(M-2)
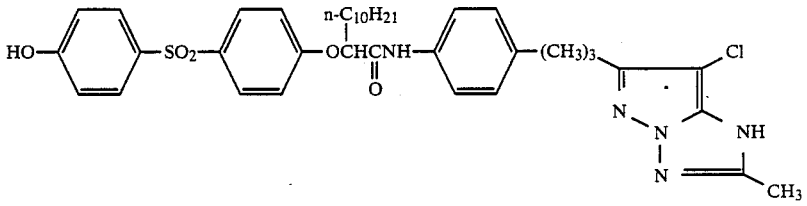
(M-3)
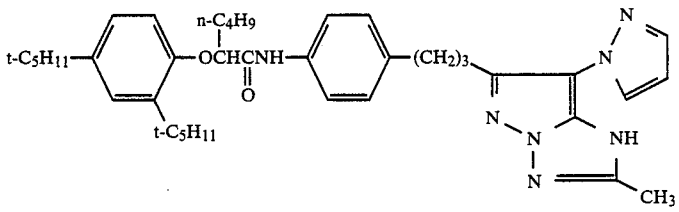
(M-4)
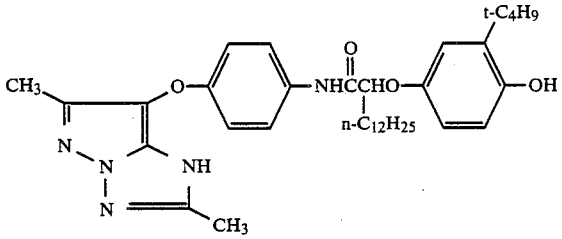
(M-5)
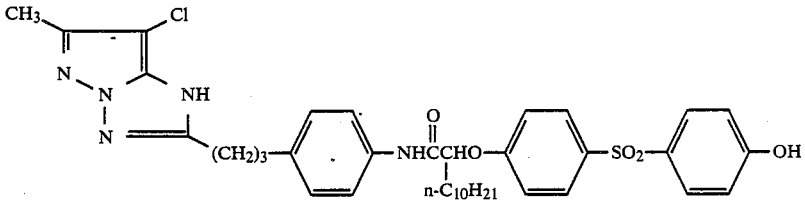
(M-6)
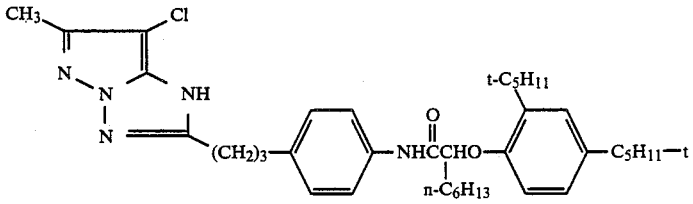
(M-7)
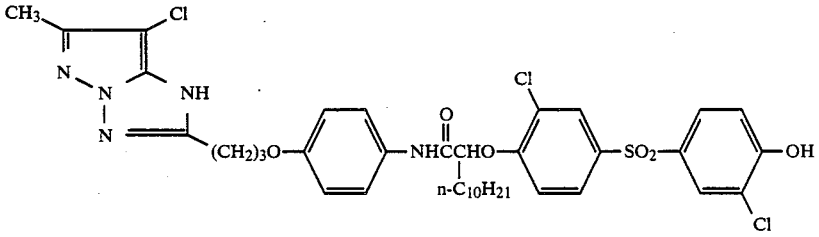

-continued
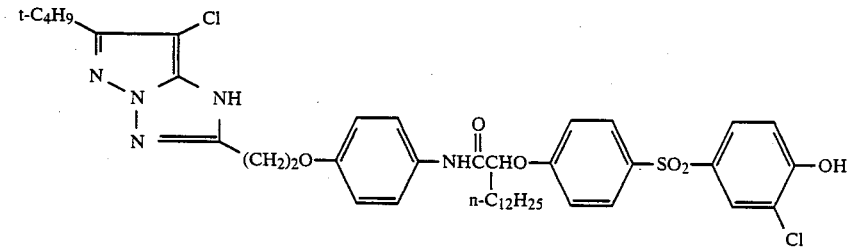
(M-8)
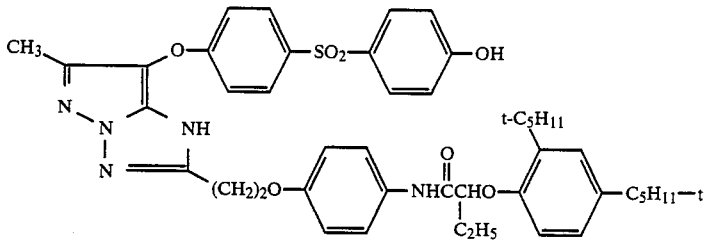
(M-9)
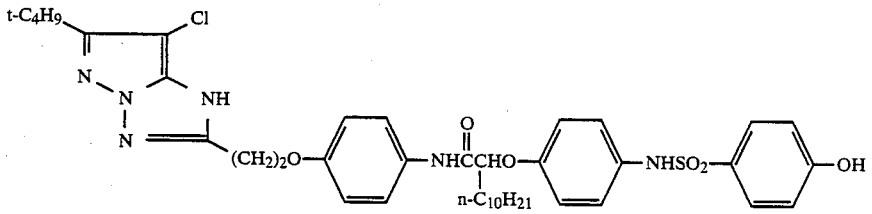
(M-10)
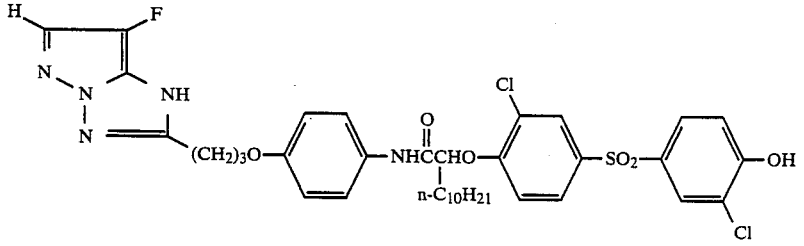
(M-11)
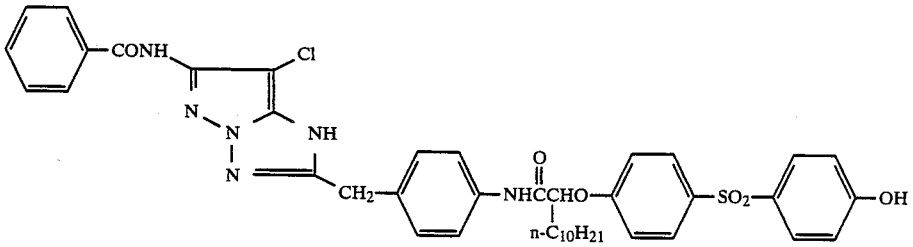
(M-12)
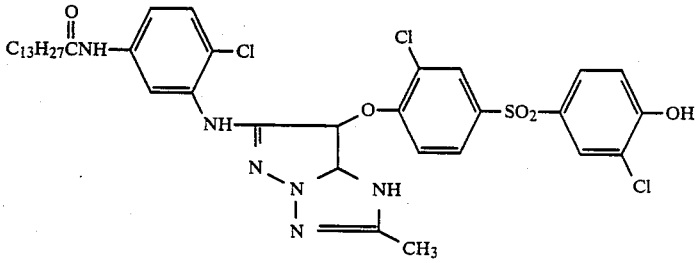
(M-13)

-continued
(M-14)
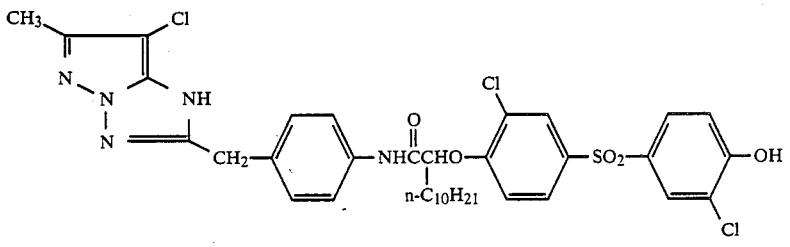
(M-15)
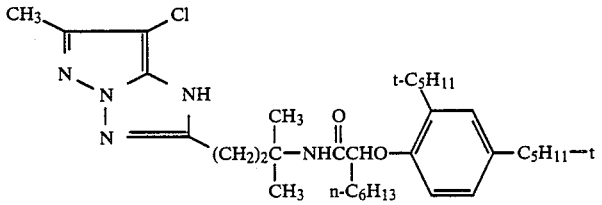
(M-16)
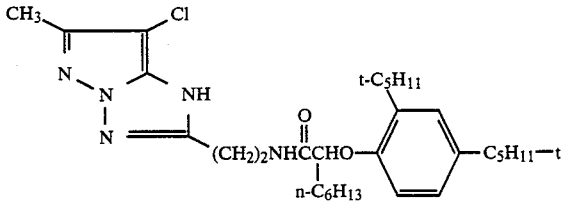
(M-17)
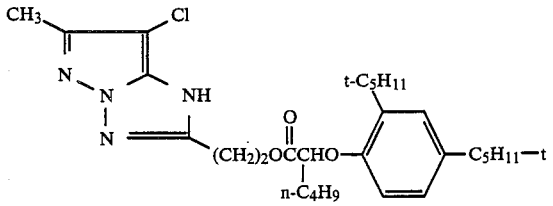
(M-18)
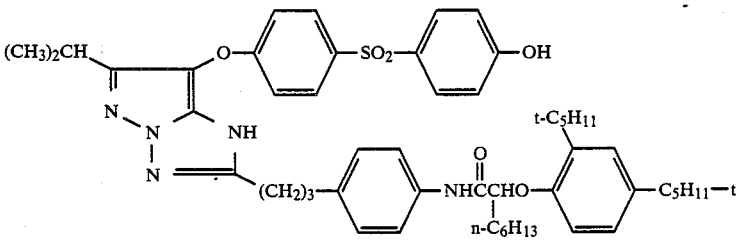
(M-19)
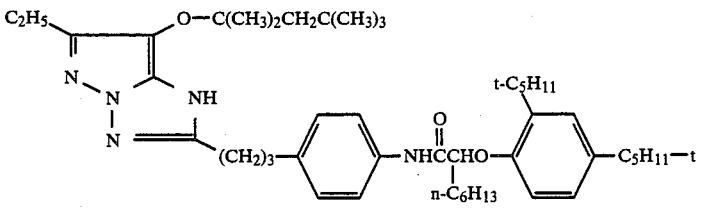
(M-20)
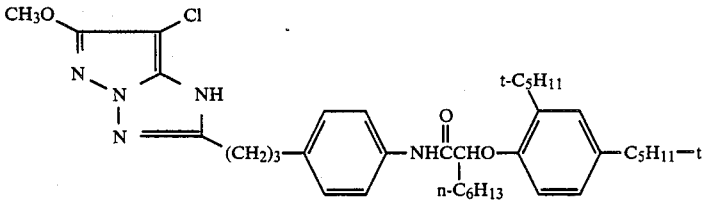

-continued
(M-21)
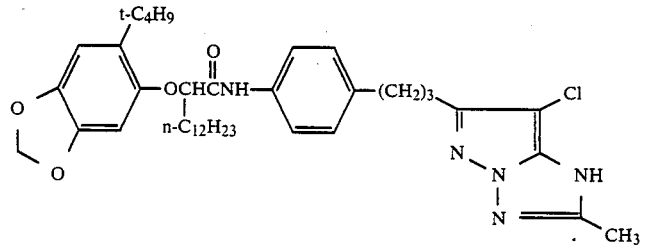
(M-22)
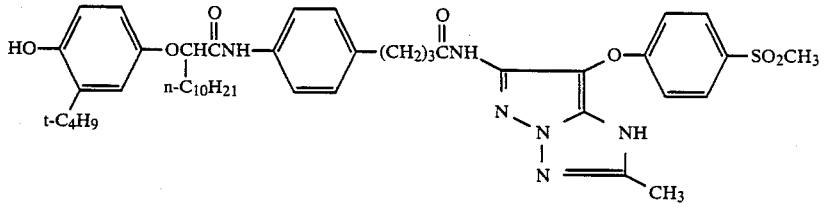
(M-23)
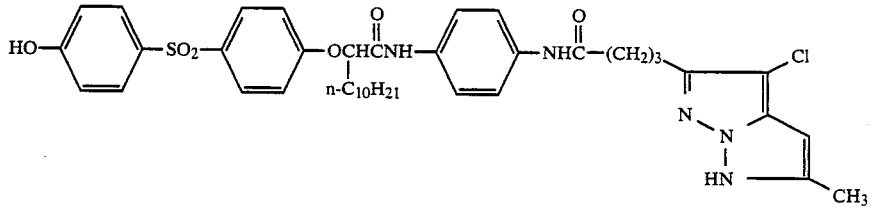
(M-24)
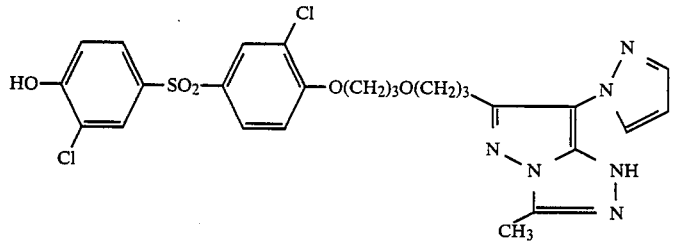
(M-25)
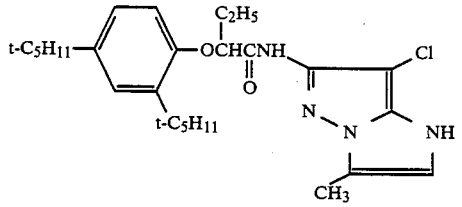
(M-26)
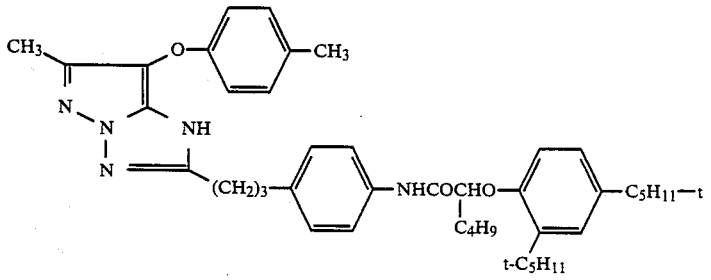

-continued
(M-27)
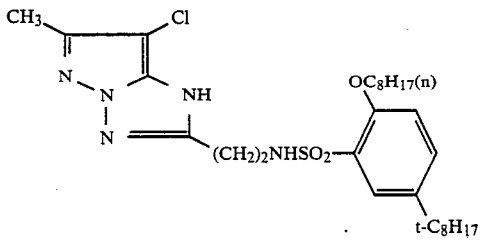
(M-28)
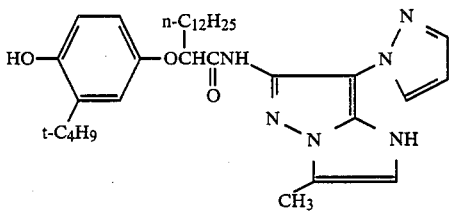
(M-29)
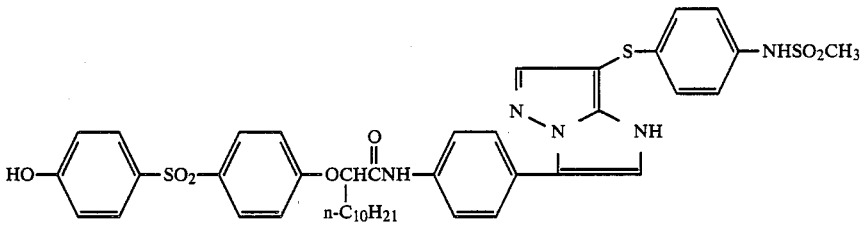
(M-30)
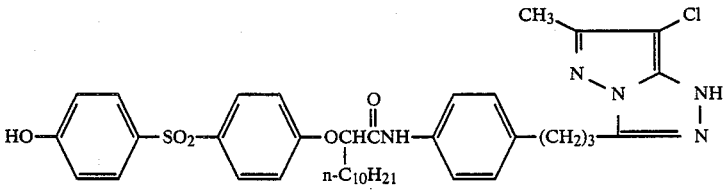
(M-31)
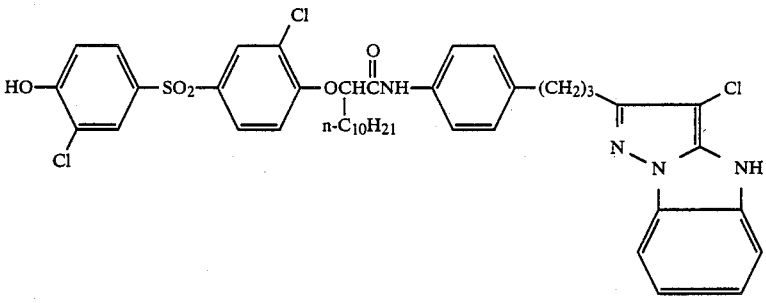
(M-32)
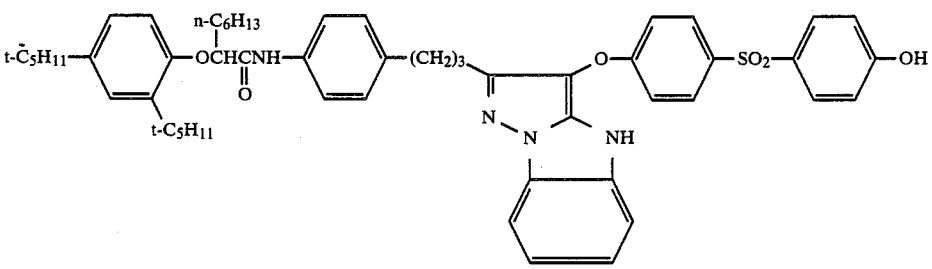

-continued
(M-33)
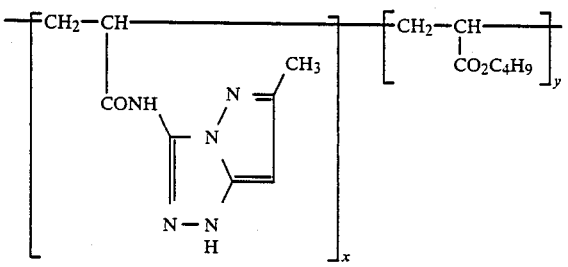
x/y = 50/50 (weight ratio)
(M-34)
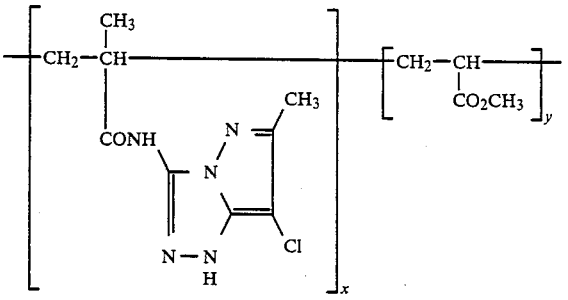
x/y = 40/60
(M-35)
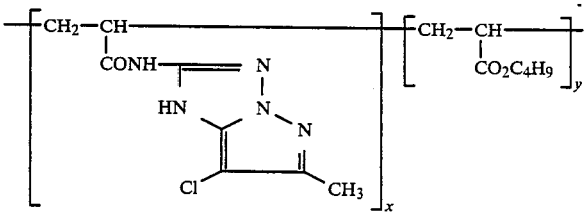
x/y = 50/50
(M-36)
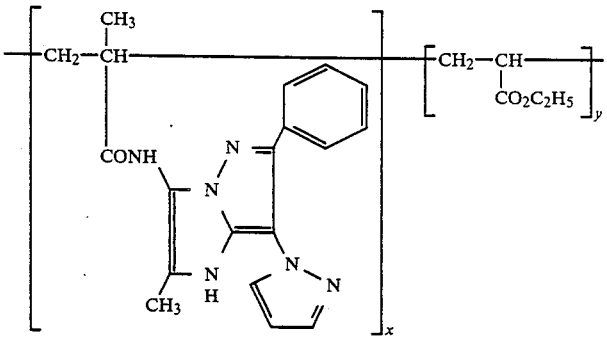
x/y = 55/45
(M-37)
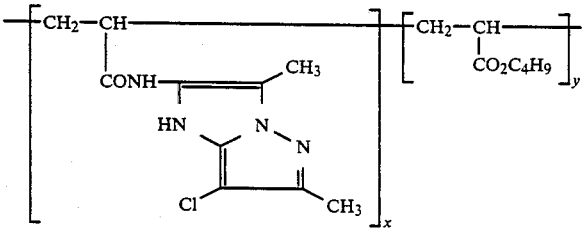
x/y = 50/50

-continued
(M-38)
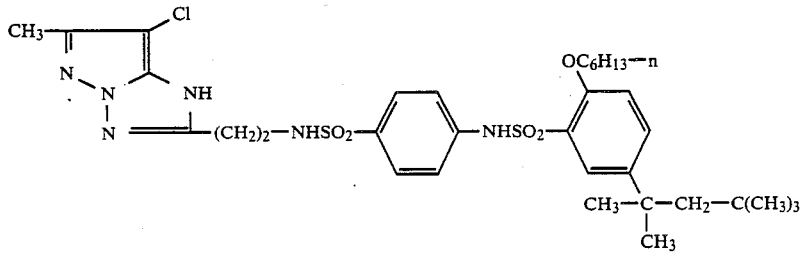
(M-39)
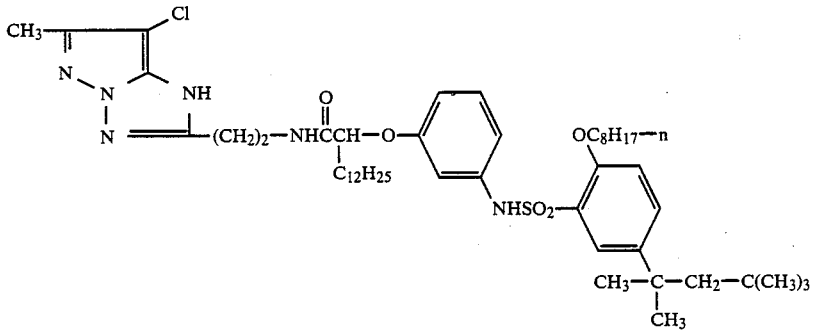
(M-40)
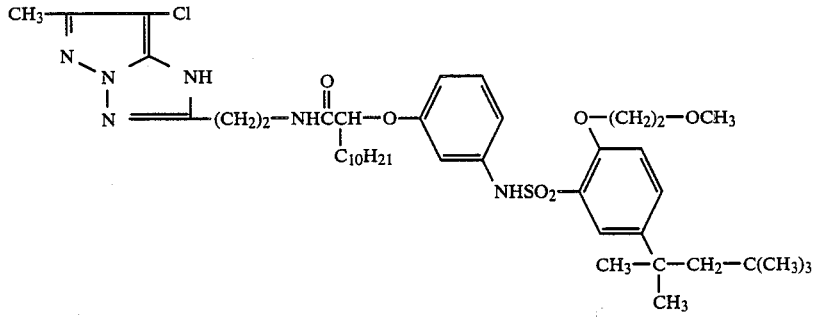
(M-41)
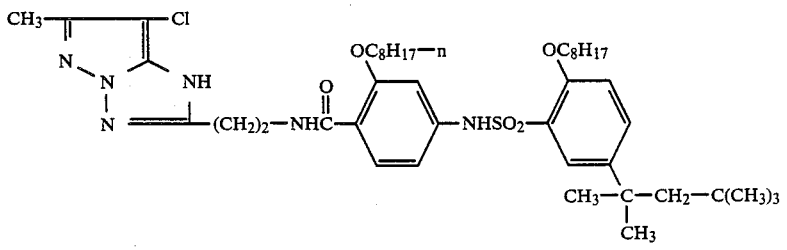
(M-42)
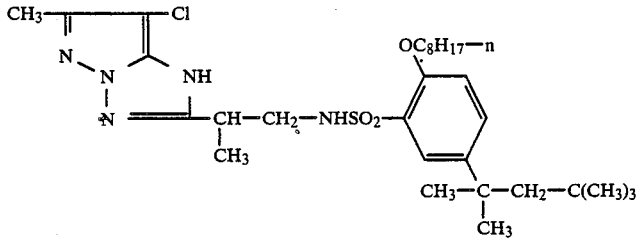
(M-43)
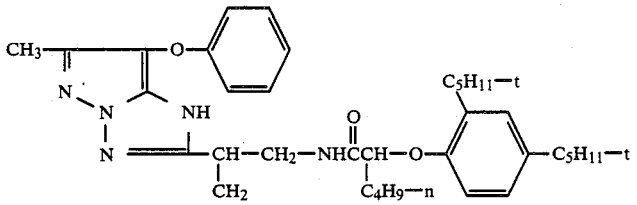

-continued
(M-44)
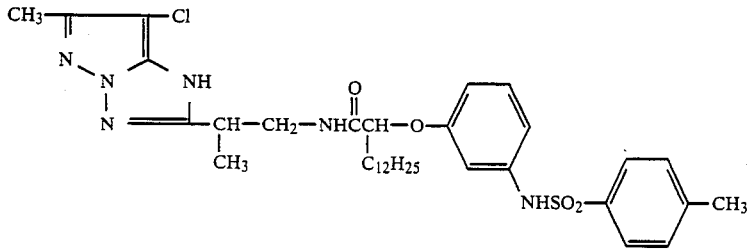
(M-45)
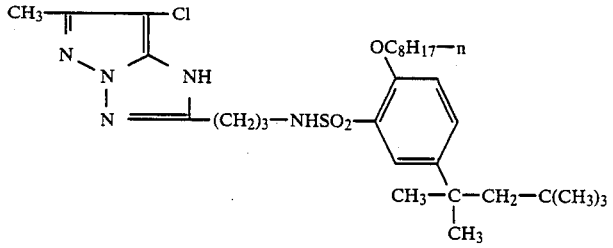
(M-46)
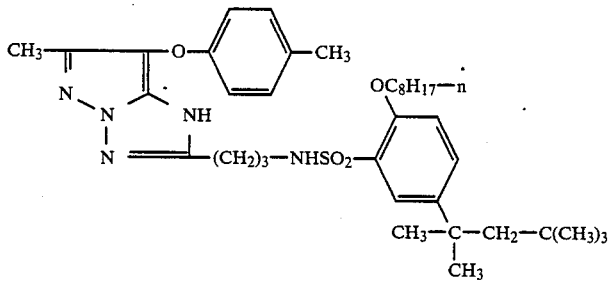
(M-47)
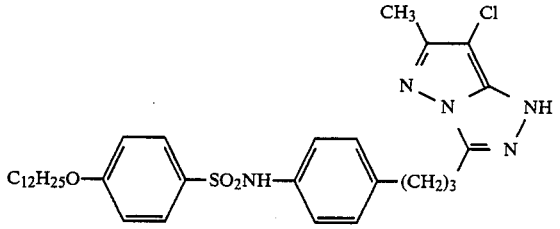
(M-48)
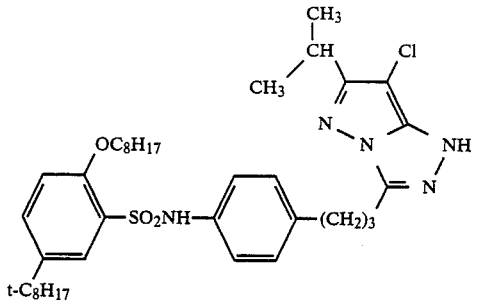
(M-49)
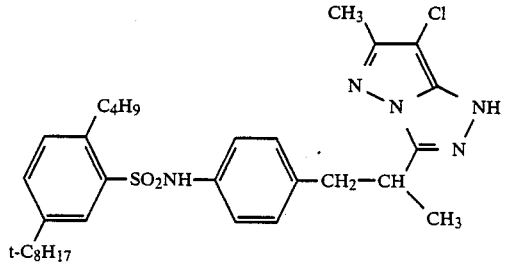

-continued
(M-50)
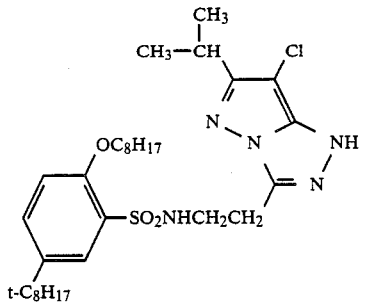
(M-51)
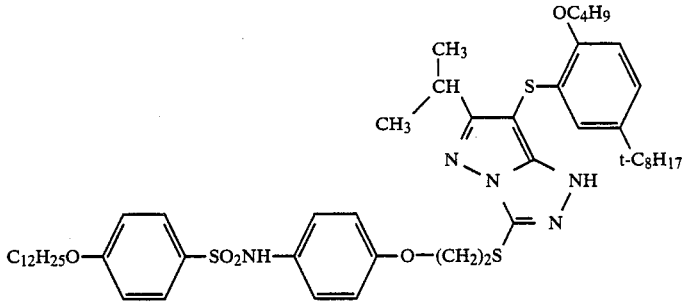
(M-52)
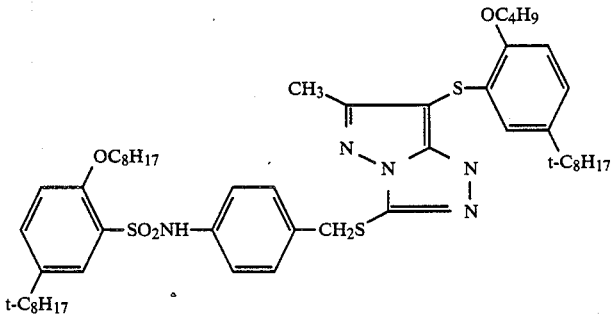
(M-53)
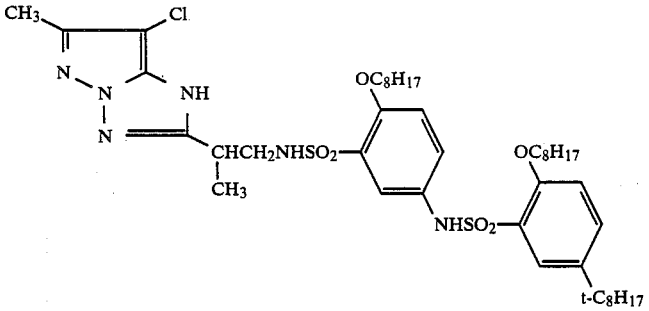
(M-54)
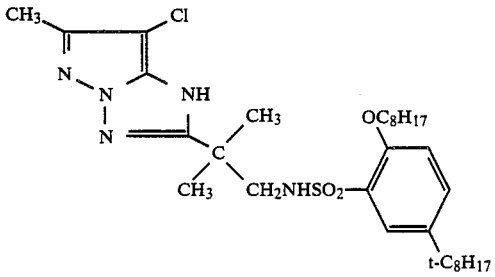

-continued
(M-55)
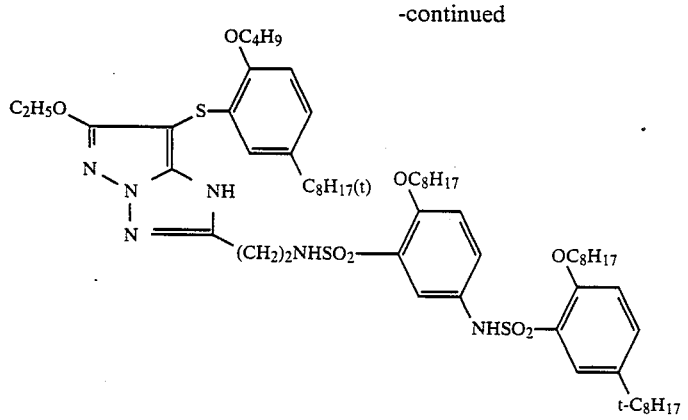
(M-56)
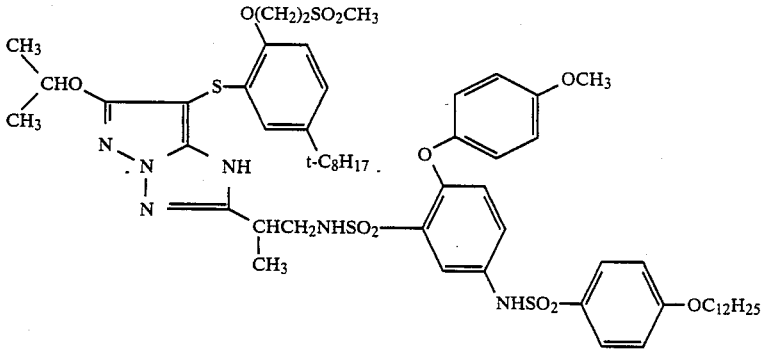
(M-57)
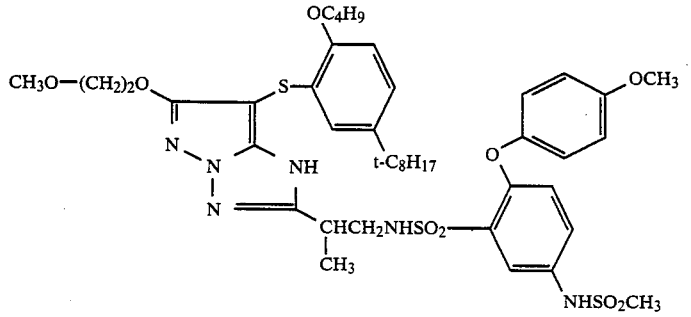
(M-58)
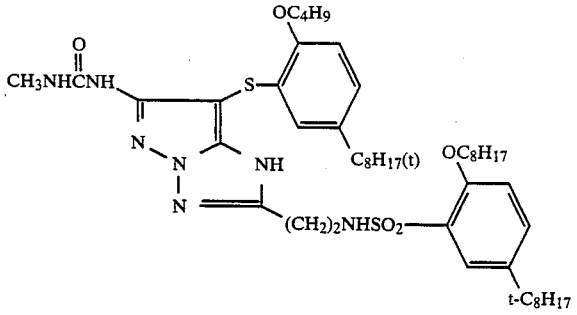
(M-59)
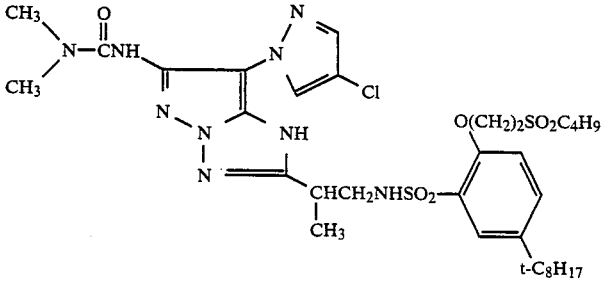

-continued (M-60)

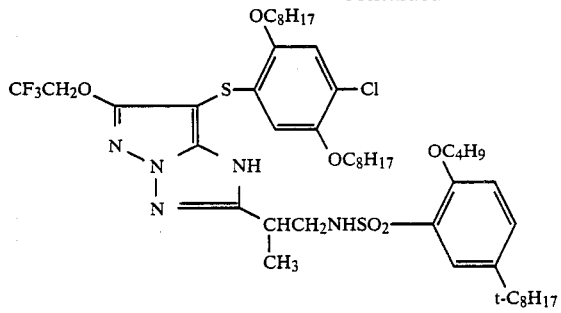

The magenta coupler described above is incorporated in a silver halide emulsion in an amount of from $2\times10^{-3}$ mol to $5\times10^{-1}$ mol, preferably from $1\times10^{-2}$ mol to $5\times10^{1}$ mol, per mol of silver in the emulsion layer.

The above-described couplers may be used as combinations of two or more kinds of the couplers for the same photographic layer in order to meet the characteristics required for a color photographic light-sensitive material or the same kind of the coupler may be incorporated in two or more photographic layers.

For introducing the coupler(s) into a silver halide emulsion layer, known methods as described, for example, in U.S. Pat. No. 2,322,027, etc., can be used. Also, the oil drop-in-water dispersion method described in Japanese Patent Application Nos. 110044/85 and 226374/85 can be employed. For example, the coupler is dissolved in a high boiling point organic solvent such as phthalic acid alkyl esters (dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamide (e.g., diethyllaurylamide, etc.), fatty acid esters (e.g., dibutoxyethyl succinate, diethyl azelate, etc.), trimesic acid esters (e.g., tributyl trimesate, etc.), etc., or a low boiling point organic solvent having boiling point of from about 30° C. to 150° C. such as low alkyl acetates (e.g., ethyl acetate, butyl acetate, etc.), ethyl propionate, sec-butyl alcohol, methyl isobutyl ketone, β-ethoxyethyl acetate, methyl cellosolve acetate, etc., and then dispersed in an aqueous hydrophilic colloid solution as the organic solvent solution. A mixture of the aforesaid high boiling point organic solvent and low boiling point organic solvent may be used for the above-described purpose.

Then, the processing step (image-forming step) of this invention is described in detail.

In the color development of this invention, the processing time is short, being at most 2 min and 30 sec. The preferred processing time is from 30 sec to 2 min and 20 sec. The term "processing time" in the development step means the time required for a color photographic material from contacting with a color developer to contacting with a subsequent processing liquid, and thus includes the travelling time of the photographic material from the development bath to the subsequent processing bath.

The color developer for use in this invention does not substantially contain benzyl alcohol. The term "does not substantially contain benzyl alcohol" means that the developer contains less than about 0.5 ml/l of benzyl alcohol, and preferably contains no benzyl alcohol.

The color developer for use in this invention contains an aromatic primary amine color developing agent. Preferred examples of the color developing agent are pphenylenediamine derivatives. Specific examples thereof are illustrated below but the developing agents for use in this invention are not limited by these compounds.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[Ethyl-N-(β-hydroxyethyl)amino]aniline
D-5: 2-Methyl-4-[N-ethyl-N-(β-hydroxyethyl-)amino]aniline
D-6: N-Ethyl-N-(β- methanesulfonamidoethyl)-3-methyl-4-aminoaniline
D-7: N-(2-Amino-5diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline
D-12: 4-Amino-3-methyl-N-ethyl-N-[β-(methanesulfonamido)ethyl]-p-phenylenediamine.

Also, the p-phenylenediamine derivative may be used as a form of the salt thereof, such as the sulfate, hydrochloride, sulfite, p-toluenesulfonate, etc.

The amount of the aromatic primary amine developing agent is from about 0.1 g to about 20 g, and preferably from about 0.5 g to about 10 g, per liter of a developer solution.

In the color developer for use in this invention, from viewpoint of the color forming property and the stability of hue and image, the compound of D-6 is particularly preferred.

The color developer for use in this invention may further contain a hydroxylamine as well known. The hydroxylamine may be used as the form of a free amine in the color developer, but is generally used as the form of a water-soluble acid salt thereof. Examples of such a salt of hydroxylamine include sulfides, oxalates, hydrochlorides, phosphates, carbonates, acetates, etc. The hydroxylamine may be substituted or unsubstituted. For example, the nitrogen atom of the hydroxylamine may be substituted by an alkyl group.

The color developer is generally used at a pH of from 9 to 12, and preferably from 9 to 11.0, in this invention.

The color developer may further contain other components generally used for color developers. For example, sodium hydroxide, potassium hydroxide, sodium carbonate, potassium carbonate, sodium tertiary phosphate, potassium tertiary phosphate, potassium metaborate, borax, etc., are used alone or as a combination thereof as an alkali agent or a pH buffer. Also, various salts such as disodium hydrogenphosphate, dipotassium hydrogenphosphate, potassium dihydrogenphosphate, sodium dihydrogenphosphate, sodium bicarbonate, potassium bicarbonate, a borate, an alkali nitrate, an alkali sulfate, etc., can be used for imparting buffer faculty to the developer, for facilitating the preparation of the color developer, or for increasing the ionic strength.

Furthermore, the color developer may contain a chelating agent for preventing the precipitation of calcium, magnesium, etc., such as polyphosphates, aminopolycarboxylic acids, phosphonocarboxylic acids, aminopolyphosphonic acids, 1-hydroxyalkylidene-1,1diphosphonic acids, etc.

If desired, the color developer may further contain a development accelerator such as the pyrimidium compounds described in U.S. Pat. Nos. 2,648,604 and 3,171,247, Japanese Patent Publication No. 9503/69, etc., other cationic compounds, cationic dyes (e.g., phenosafranine, etc.), neutral salts (e.g., thallium nitrate, potassium nitrate, etc.), polyethylene glycol and the derivatives thereof described in Japanese Patent Publication No. 9304/69, U.S. Pat. Nos. 2,533,990, 2,531,832, 2,950,970, 2,577,127, etc., nonionic compounds (e.g., polythioethers, etc.), and thioether compounds described in U.S. Pat. No. 3,201,242, etc. In particular, the thioether compounds and the 3-pyrazolidones are preferred.

Moreover, the color developer may contain sodium sulfite, potassium sulfite, potassium hydrogensulfite, sodium hydrogensulfite, etc., as a preservative.

Also, if desired, the color developer may contain an antifoggant. Examples of the antifoggant include alkali metal halides such as potassium bromide, sodium bromide, potassium iodide, etc., and organic antifoggants such as nitrogen-containing heterocyclic compounds (e.g., benzotriazole, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.), mercapto-substituted heterocyclic compounds (e.g., 1-phenyl-5-mercaptotetraxole, 2-mercaptobenzimidazole, 2-mercaptobenzothiazole, etc.), and mercapto substituted aromatic compounds (e.g., thiosalicylic acid, etc.). The nitrogen-containing heterocyclic compounds are particularly preferred. The antifoggant may be accumulated in a color developer by dissolving out from color photographic materials during processing.

After color development, the silver halide color photographic material is usually bleached. The bleach processing may be performed simultaneously with a fix processing (bleach-fix or blix processing) or separately from a fix processing. As the bleaching agent, there are compounds of polyvalent metals such as iron(III), cobalt(III), chromium(VI), copper(II), etc., peracids, quinones, nitroso compounds, etc. Examples of the bleaching agent include the ferricyanides of the polyvalent metals, the bichromates of the polyvalent metals, organic complex salts of iron (III) or cobalt (III) (e.g., the complex salts of the metal and an aminopolycarboxylic acid such as ethylenediaminetetraacetic acid, diethylenetriaminepentaacetic acid, nitrilotriacetic acid, 1,3-diamino-2-propanoltetraacetic acid, etc., or other organic acid such as citric acid, tartaric acid, malic acid, etc.), persulfates, manganates, nitrosophenol, etc. In these materials, potassium ferricyanide, sodium ethylenediaminetetraacetic acid iron (III), ammonium ethylenediaminetetraacetic acid iron (III), ammonium diethylenetriaminepentaacetic acid iron (III), and a persulfate are particularly preferred in this invention. The ethylenediaminetetraacetic acid iron (III) complex salt is useful for both a bleach liquid and a blix liquid.

Also, if desired, the bleaching solution or the blixing solution may contain various kinds of bleach accelerators. Examples of the bleach accelerator are bromide ions, iodide ions, the thiourea compounds described in U.S. Pat No. 3,706,561, Japanese Patent Publication Nos. 8506/70, 26586/74, Japanese Patent Application (OPI) Nos. 32735/78, 36233/78 and 37016/78, the thiol compounds described in Japanese Patent Application (OPI) Nos. 124424/78, 95631/78, 57831/78, 32736/78, 65732/78, 52534/79 and U.S. Pat. No. 3,893,858, the heterocyclic compounds described in Japanese Patent Application (OPI) Nos. 59644/74, 140129/75, 28426/78, 141623/78, 104232/78 and 35727/79, the thioether compounds described in Japanese Patent Application (OPI) Nos. 20832/77, 25064/80 and 26506/80, the quaternary amines described in Japanese Patent Application (OPI) No. 84440/73, and the thiocarbamoyls described in Japanese Patent Application (OPI) No. 42349/74.

The blixing solution or a fixing solution contains a fixing agent such as thiosulfates, thiocyanates, thioether compounds, thioureas, iodides, etc. In these fixing agents, thiosulfates are most generally used. It is preferred that the blixing solution or the fixing solution further contains a preservative such as a sulfite, a hydrogensulfite, a carbonyl hydrogensulfite addition product, etc.

After blix processing or fix processing, the color photographic material is usually subjected to wash processing. For the wash processing step, various kinds of compounds can be used for the purposes of preventing the occurrence of precipitation and saving water. Examples of such compounds are water softeners such as inorganic phosphoric acids, aminopolycarboxylic acids, organic phosphoric acids, etc., for preventing the occurrence of precipitations, germicides or fungicides for preventing the propagation of various bacteria, algae, and fungi, hardening agents such as magnesium salts and aluminum salts, and surface active agents for reducing the drying load or preventing uneven finishing.

Also, the compounds described in L. E. West, "Water Quality Criteria", *Photographic Science and Engineering*, Vol. 9, No. 6 (1965) may be used for the wash step. The chelating agents and fungicides described in the above literature are particularly effective. Furthermore, by employing a multistage (e.g., 2 to 5 stages) countercurrent system for the wash processing step, a significant amount of water can be saved.

Also, after the wash step or in place of the wash step, the multistage countercurrent stabilization step as described in Japanese Patent Application (OPI) No. 8543/82 can be used. In the case of the aforesaid step, the countercurrent step of 2 to 9 tanks is required.

The stabilizing bath may contain various kinds of compounds for stabilizing color images formed. Examples of the compounds are formalin or buffers for controlling the pH of the photographic layer(s) (e.g., borates, metaborates, borax, phosphates, carbonates, potassium hydroxide, sodium hydroxide, aqueous ammonia, monocarboxylic acids, dicarboxylic acids, polycarboxylic acids, etc.). Also, if desired, the stabilization liquid may further contain a water softener (e.g., inorganic phosphoric acids, aminopolycarboxylic acids, organic phosphoric acids, aminopolyphosphonic acids, phosphonocarboxylic acids, etc.), a germicide (e.g., proxel, isothiazolone, 4-thiazolinebenzimidazole, halogenated phenols, etc.), a surface active agent, a brightening agent, a hardening agent, etc.

Still further, the stabilization liquid may further contain various ammonium salts such as ammonium chloride, ammonium nitrate, ammonium sulfate, ammonium phosphate, ammonium sulfite, ammonium thiosulfate, etc., for controlling the pH of the photographic layer(s) of the color photographic material after processing.

The processing process of this invention is particularly effective in the case of employing a water saving processing step wherein the replenishing amount of the wash solution or the stabilization solution is from about 3 to 30 times the amount of a solution carried from the pre-bath. The reason is that when the amount of wash water is greatly reduced for water saving, the light fading of the color photographic material after processing becomes severe in the case of using coupler(s) represented by formula (II) described above for the color photographic material, while such a problem does not occur in the case of this invention.

In the case of employing continuous processing in the process of this invention, the occurrence of the deviation of the composition of each processing solution can be prevented by using a replenisher for the processing solution, whereby a constant finish is obtained. The amount of the replenisher can be reduced to a half or below a half of the standard amount of the replenisher used, thus reducing processing costs.

If desired, each processing tank may be equipped with a heater, a temperature sensor, a liquid level sensor, a circulating pump, a filter, a floating lid, a squeegee, a nitrogen gas stirrer, an air stirrer, etc.

The silver halide emulsion for use in this invention contains silver bromide, a silver chlorobromide, or silver chloride each containing substantially no silver iodide and contains preferably silver chlorobromide containing from 2 to 98 mol % of silver chloride.

The silver halide grains for use in this invention may differ in composition or phase between the inside and the surface layer thereof, may have a multiphase structure having a junction structure, or may have a uniform phase or composition throughout the whole grain. Also, the silver halide grains may be composed of a mixture of these grains having different phase structures.

The mean grain size (the diameter of the grain when the grain is spherical or resembles spherical, or the mean value based on the project area using the edge length as the grain size when the grain is a cubic grain) of the silver halide grains for use in this invention is preferably from 0.1 μm to 2 μm, and more preferably from 0.15 μm to 1 μm.

The grain size distribution of a silver halide emulsion for use in this invention may be narrow or broad, but a so-called monodispersed silver halide emulsion wherein the value (fluctuation) obtained by dividing the standard deviation in the grain distribution curve by the mean grain size is within about 20%, and preferably within 15%, is preferably used in this invention. Also, for satisfying the gradation required for a color photographic material, two or more kinds of monodispersed silver halide emulsions (preferably having the above-described fluctuation as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in this invention may have a regular crystal form such as cubic, octahedral, dodecahedral, tetradecahedral, etc., or an irregular crystal form such as spherical, or further a composite form of these crystal forms. Also, a tabular grain silver halide emulsion can be used in this invention. In particular, a tabular grain silver halide emulsion wherein tabular silver halide grains having an aspect ration (length/width) of at least 5, in particular, at least 8, account for at least 50% of the total project area of the silver halide grains may be used. The silver halide emulsion for use in this invention may be a mixture of these emulsions containing silver halide grains each having different crystal form. Also, the silver halide grains may be of a surface latent image type capable of forming latent images mainly on the surfaces thereof or of an internal latent image type capable of forming latent images mainly in the inside thereof.

The silver halide photographic emulsions for use in this invention can be prepared using the methods described, for example, in P. Glafkides, *Chimie et Physique Photographique* (published by Paul Montel, 1967); G. F. Duffin, *Photographic Emulsion Chemistry* (published by Focal Press, 1966); V. L. Zelikman et al., Making and Coating Photographic Emulsion (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the existence of excessive silver ions can be employed. As one system of the double jet method, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

Furthermore, a silver halide emulsion prepared by a so-called conversion method including a step of converting a silver halide already formed into a silver halide having a less solubility product before the formation step of the silver halide grains is finished or a silver halide emulsion prepared by applying the similar halogen conversion to silver halide grains after finishing the formation step of the silver halide grains can also be used.

The silver halide grains may also be formed, or physically ripened, in the presence of a cadmium salt, a zinc salt, a lead salt, a thallium salt, an iridium salt or a complex salt thereof, a rhodium salt or a complex salt thereof, an iron salt or a complex salt thereof, etc.

After the formation of silver halide grains, the silver halide emulsion thus obtained is usually subjected to physical ripening, subjected to desalting, and then subjected to chemical ripening before coating.

In this case, a silver halide solvent (e.g., ammonia, potassium rhodanate, and the thioethers and thione compounds described in U.S. Pat. No. 3,271,157, Japanese Patent Application (OPI) Nos. 12360/76, 82408/78, 144319/78, 100717/79, 155828/79, etc.) can be used for the precipitation, physical ripening, and chemical ripening of silver halide emulsions. For removing soluble salts from silver halide emulsion after physical ripening, a noodle washing method, a flocculation settling method, an ultrafiltration method, etc., can be used.

For the chemical sensitization of the silver halide emulsions for use in this invention, a sulfur sensitization method using active gelatin or a sulfur-containing compound capable of reacting silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a metal compound (e.g., gold complex salts and complex salts of metals belonging to group VIII of the Periodic Table, such as platinum, iridium, palladium, rhodium, iron, etc.) can be used individually or as a combination thereof.

Of the chemical sensitization methods described above, the sulfur sensitization method is preferably used.

The color photographic material which is processed by the process of this invention has preferably at least one blue-sensitive emulsion layer, at least one green-sensitive emulsion layer and at least one red-sensitive emulsion layer, the silver halide emulsions of which are spectrally sensitized by methine dyes, etc., to have each color sensitivity. The dyes used for the purpose include cyanine dyes, merocyanine dyes, complex cyanine dyes, complex merocyanine dyes, holopolar cyanine dyes, hemicyanine dyes, styryl dyes, and hemioxonal dyes. The particularly useful dyes are cyanine dyes, merocyanine dyes and complex merocyanine dyes.

For these dyes can be applied various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4dione nuclei, thiazolidine2,4-dione nuclei, rhodanine nuclei, thiobarbituric acid nuclei, etc., as nuclei having a ketomethylene structure.

The above-described sensitizing dyes can be used singly or as a combination thereof. A combination of sensitizing dyes is frequently used for the purpose of super color sensitization. Specific examples of the super color sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77, 109925/77, etc.

The silver halide emulsions for use in this invention may further contain, together with the sensitizing dye(s), dyes having no spectral sensitizing action by themselves or materials which do not substantially absorb visible light but show supersensitizing action.

It is preferred that the couplers contained in the color photographic materials which are processed by the process of this invention are nondiffusible due to having a ballast group or being polymerized.

Also, the use of 2-equivalent color couplers substituted by a releasable group can reduce the amount of silver for the color photographic materials as compared to 4-equivalent color couplers having a hydrogen atom at the coupling active group. Couplers giving colored dyes having a proper diffusibility, non-color-forming couplers, DIR couplers releasing a development inhibitor with coupling reaction, or DAR couplers releasing a development accelerator with coupling reaction can also be used in this invention.

In this invention, yellow couplers, magenta couplers (including the magenta couplers of formula (II) described hereinbefore), and cyan couplers can be used for the color photographic materials when this invention is applied for multicolor photographic materials.

As the yellow couplers for use in this invention, there are oil protect type acylacetamido couplers as the typical examples. Specific examples of these couplers are described in U.S. Pat. Nos. 2,407,210, 2,875,057, 3,265,506, etc. In this invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom releasing type yellow couplers described in Japanese Patent Publication No. 10739/83, U.S. Pat. Nos. 4,401,752, 4,326,024, *Research Disclosure*, No. 18053 (April, 1979), British Pat. No. 1,425,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

In this invention, the pyrazoloazole series magenta couplers represented by formula (II) described above are used as the magenta couplers as described hereinbefore, oil protect type indazolone series or cyanoacetyl series, preferably 5- pyrazolone series magenta couplers and other pyrazoloazole series couplers, can be used together with the aforesaid pyrazoloazole series couplers. As the 5-pyrazolone series magenta couplers which can be used together with or as a combination with the pyrazoloazole couplers of formula (II) described above, couplers substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,575, 3,062,653, 3,152,896, 3,936,015, etc. Also, as the releasable groups for the 2-equivalent 5-pyrazoline series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 give high coloring density.

As the cyan couplers for use in this invention, there are oil protect type naphthol series or phenol series couplers. Specific examples of the naphthol series couplers include the cyan couplers described in U.S. Pat. No. 2,474,293 and preferably the oxygen atomreleasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in this invention and typical examples of these cyan couplers include the phenol series cyan couplers having an alkyl group of 2 or more carbon atoms at the meta-position of the phenol nucleus described in U.S. Pat. No. 3,772,002, the 2,5-diacylaminosubstituted phenol series cyan couplers described in U.S. Pat. Nos. 2,772,162, 3,758,308, 4,126,396, 4,334,011, 4,327,173, West German Patent Application (OLS) No. 3,329,729, Japanese Patent Application (OPI) No. 42671/83, etc., and the phenol series couplers having a phenylureido group at the 2-position thereof and an acylamino group at the 5-position thereof described in U.S. Pat. Nos. 3,446,622, 4,333,999, 4,451,559 and 4,427,767.

In this invention, by using couplers giving colored dyes having a proper diffusibility together with the aforesaid color couplers, the graininess of color images formed can be improved. Specific examples of the magenta couplers giving such diffusible dyes are described in U.S. Pat. No. 4,366,237 and British Pat. No. 2,125,570 and specific examples of yellow, magenta and cyan couplers of this type are described in European Pat. No. 96,570 and West German Patent Application (OLS) No. 3,234,533.

The dye-forming couplers or the above-described specific couplers for use in this invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in this invention may be used for the same photographic layer of a color photographic material as a combination of two or more kinds thereof for meeting particular characteristics desired for a color photographic material, or the same kind of coupler may be used for two or more photographic layers for meeting desired characteristics.

The couplers for use in this invention can be introduced into color photographic light-sensitive materials by the oil-in-water dispersion method is described hereinbefore or by a latex dispersion method. Specific examples of the procedure, the effects, and the latexes for the latex dispersion method are described in U.S. Pat. No. 4,199,363 and West German Patent Application (OLS) Nos. 2,541,275, 2,541.230, etc.

The standard amount of the color coupler is in the range of from 0.001 to 1 mol per mol of lightsensitive silver halide of a silver halide emulsion and the preferred amount is from 0.01 to 0.5 mol for yellow coupler and from 0.002 to 0.3 mol for cyan coupler.

The color photographic materials for use in this invention contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

Also, the color photographic light-sensitive materials for use in this invention may further contain organic anti-fading agents. Examples of such organic anti-fading agents include hindered phenols such as hydroquinones, 6-hydroxycoumarones, 5-hydroxycoumarans, spirochromans, p-alkoxyphenols, or bisphenols, gallic acid derivatives, methylenedioxybenzenes, aminophenols, hindered amines, and also the either or ester derivatives obtained by silylating or alkylating the phenolic hydroxy groups of these compounds. Also, metal complexes such as (bissalicylaldoximate) nickel complex and (bis-N,N-dialkyldithiocarbamate) nickel complex can be used as anti-fading agent.

The use of the compound having both the moiety structure of hindered amine and hindered phenol in the same molecule as described in U.S. Pat. No. 4,268,593 for the color photographic materials give good results for preventing the deterioration of the yellow dye images by heat, humidity, and light. Also, for repreventing the deterioration of magenta dye images, particularly by light, the use of the spiroindanes described in Japanese Patent Application (OPI) No. 159644/81 or the chromans having a hydroquinone diether or monoether as a substituent described in Japanese Patent Application (OPI) No. 89835/80 gives preferred results.

For improving the stability of cyan images, in particular the light fastness thereof, it is preferred to use benzotriazole series ultraviolet absorbents for the color photographic materials. The ultraviolet absorbent may be co-emulsified with a cyan coupler.

The ultraviolet absorbent may be used in a coating amount sufficient for imparting light stability to the cyan dye images formed, but if too great of an amount of the agent is used, yellowing sometimes occurs at the unexposed portions (background portions) of color photographic light-sensitive material after processing, and hence the amount is in the range of usually from $1\times10^{-4}$ mol/m$^2$ to $2\times10^{-3}$ mol/m$^2$, preferably from $5\times10^{-4}$ to $1.5\times10^{-3}$ mol/m$^2$.

In an ordinary layer constitution of color photographic paper, an ultraviolet absorbent exists in one or preferably both layers disposed at both sides of a cyan coupler-containing red-sensitive silver halide emulsion layer. Also, when an ultraviolet absorbent is incorporated in an interlayer between a green-sensitive emulsion layer and a red-sensitive emulsion layer, the agent may be so-emulsified with a color mixing preventing agent. When an ultraviolet absorbent exists in a protective layer, another protective layer may be formed as the outermost layer and the protective layer may contain a matting agent, optionally having particle sizes. Moreover, the color photographic materials for use in this invention may contain ultraviolet absorbents in hydrophilic colloid layers thereof.

Color photographic materials for use in this invention may further contain water-soluble dyes in the hydrophilic colloid layers thereof as filter dyes or for the purposes of irradiation prevention, halation prevention, etc.

The color photographic materials for use in this invention may further contain brightening agents such as stilbene series compounds, triazine series compounds, oxazole series compounds, coumarine series compounds, etc., in the photographic emulsion layers or other hydrophilic colloid layers. In this case, as the brightening agents, water-soluble brightening agents may be used or water-insoluble brightening agents may be used as a form of the dispersion thereof.

The processing process of this invention can be applied to multilayer multicolor photographic materials having at least two photographic emulsion layers having different spectral sensitization on a support. A multilayer natural color photographic material usually has at least one red-sensitive emulsion layer, at least one green-sensitive emulsion layer, and at least one blue-sensitive emulsion layer on a support. The disposition order of these emulsion layers can be selected according to the intended use. Also, each emulsion layer described above may be composed of two or more emulsion layers, each having different sensitivities. Also, a light-insensitive layer may exist between two or more emulsion layers each having the same color sensitivity.

It is preferred that the color photographic material for use in this invention has proper auxiliary layers (also referred to as "photograph-constituting layers) such as a protective layer or protective layers, interlayers, a filter layer, an antihalation layer, a backing layer, etc., in addition to silver halide emulsion layers.

As the binder or protective colloid which can be used for the silver halide emulsion layers, interlayers, etc., of the color photographic materials in this invention, gelatin is advantageously used, but other hydrophilic colloids can also be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfates, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, the hydrolyzed products or enzyme decomposed products of gelatin can be used.

The color photographic materials for use in this invention may further contain various stabilizers, stain preventing agents, developing agents or precursors thereof, development accelerators or precursors thereof, lubricants, mordants, matting agents, antistatic agents, plasticizers and other additives useful for the color photographic materials in addition to the above-described additives. Examples of these additives are described in *Research Disclosure,* No. 17643 (December, 1978) and ibid., No. 18716 (November, 1979).

The process of this invention can preferably be applied to a color photographic material having a reflective support. The reflective support has a high reflectivity for clearly viewing dye images formed in silver halide emulsion layers of the color photographic material. Such a reflective support comprises a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above. Examples of the reflective support include baryta-coated papers, polyethylene-coated papers, polypropylene series synthetic papers, and transparent supports (e.g., glass plates, polyester films such as polyethylene terephthalate films, cellulose triacetate films, or cellulose nitrate films, polyamide films polycarbonate films, polystyrene films, etc.) having a reflective layer or containing a reflective material. These supports can be appropriately selected according to the intended purposes.

The following examples are intended to illustrate the present invention but not to limit it in any way.

EXAMPLE 1

Each of multilayer color photographic papers (Samples (A) to (E)) was prepared by forming the layers having the compositions shown below on a paper support both surfaces of which were coated with polyethylene. The coating compositions for the layers were prepared as follows.

Coating Composition for First Layer:

In a mixture of 27.2 ml of ethyl acetate and 7.9 ml of Solvent (c) were dissolved 19.1 g of Yellow Coupler (a) and 4.4 g of Color Image Stabilizer (b) and the solution thus obtained was dispersed by emulsification in 185 ml of an aqueous 10 wt % gelatin solution containing 8 ml of a 10 wt % sodium dodecylbenzenesulfonate solution. On the other hand, 90 g of a silver chlorobromide emulsion (containing 80 mol % silver bromide and 70 g/kg of silver) containing the blue-sensitive sensitizing dye shown below in an amount of $7.0\times10^{-4}$ mol per mol of silver chlorobromide was prepared. The emulsified dispersion prepared above was mixed with the aforesaid silver halide emulsion and the gelatin concentration was adjusted as shown below to provide the coating composition for the first layer. Coating compositions for the second layer to the seventh layer were also prepared by the same manner as in the first layer. As a gelatin hardening agent for each layer, 2,4-dichloro-6-hydroxy-s-triazine sodium salt was used.

The compositions of the layers were as follows. In addition, the polyethylene-coated paper contained titanium dioxide as a white pigment and ultramarine as a bluish dye.

| | |
|---|---|
| First Layer: Blue-Sensitive Emulsion Layer | |
| Mixed silver chlorobromide emulsion (silver bromide: 80 mol %) | 0.30 g/m$^2$ as Ag (silver content) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |
| Second Layer: Color Mixing Preventing Layer | |
| Gelatin | 0.99 g/m$^2$ |
| Color Mixing Preventing Agent (d) | 0.08 g/m$^2$ |
| Third Layer: Green-Sensitive Emulsion Layer | |
| Mixed silver chlorobromide emulsion (silver bromide: 70 mol %) | 0.16 g/m$^2$ as Ag |
| Gelatin | 1.80 g/m$^2$ |
| Magenta coupler (shown below) | 0.34 g/m$^2$ |
| Color Image Stabilizer (f) | 0.20 g/m$^2$ |
| Solvent (g) | 0.68 ml/m$^2$ |
| Fourth Layer: Ultraviolet Absorbing Layer | |
| Gelatin | 1.60 g/m$^2$ |
| Ultraviolet Absorbent (h) | 0.62 g/m$^2$ |
| Color Mixing Preventing Agent (i) | 0.05 g/m$^2$ |
| Solvent (j) | 0.26 ml/m$^2$ |
| Fifth Layer: Red-Sensitive Emulsion Layer | |
| Mixed silver chlorobromide emulsion (silver chloride: 70 mol %) | 0.26 g/m$^2$ as Ag |
| Gelatin | 0.98 g/m$^2$ |
| Cyan Coupler (k) | 0.38 g/m$^2$ |
| Color Image Stabilizer (l) | 0.17 g/m$^2$ |
| Solvent (m) | 0.23 ml/m$^2$ |

-continued

| | |
|---|---|
| Sixth Layer: Ultraviolet Absorbing Layer | |
| Gelatin | 0.54 g/m$^2$ |
| Ultraviolet Absorbent (h) | 0.21 g/m$^2$ |
| Solvent (j) | 0.09 ml/m$^2$ |
| Seventh Layer: Protective Layer | |
| Gelatin | 1.33 g/m$^2$ |
| Acryl-modified copolymer of polyvinyl alcohol (modification degree of 17%) | 0.17 g/m$^2$ |

| Mixed Silver Chlorobromide | | Mean Grain Size ($\bar{\gamma}$) Measured by Project Area Method (μm) | Coefficient of Variation (S*/$\bar{\gamma}$) | Mixed Ratio (by weight) | Silver Bromide Content (mol %) |
|---|---|---|---|---|---|
| First | Em 1 | 1 | 0.08 | 1/1 | 80 |
| Layer | Em 2 | 0.75 | 0.07 | | 80 |
| Third | Em 3 | 0.5 | 0.09 | 3/7 | 70 |
| Layer | Em 4 | 0.4 | 0.10 | | 70 |
| Fifth | Em 5 | 0.5 | 0.09 | 3/7 | 70 |
| Layer | Em 6 | 0.4 | 0.10 | | 70 |

*S stands for statistic standard deviation.

In addition, for each emulsion layer, the following spectral sensitizers were used.

For the Blue-Sensitive Emulsion Layer:

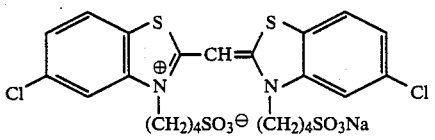

($7.0 \times 10^{-4}$ mol per mol of silver halide)

For the Green-Sensitive Emulsion Layer:

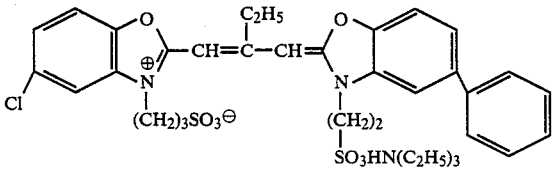

($4.0 \times 10^{-4}$ mol per mol of silver halide)

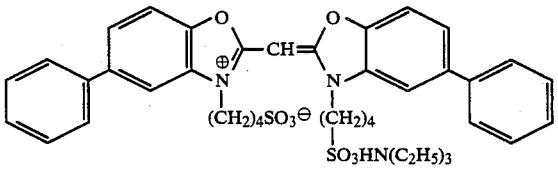

($7.0 \times 10^{-5}$ mol per mol of silver halide)

For the Red-Sensitive Emulsion Layer:

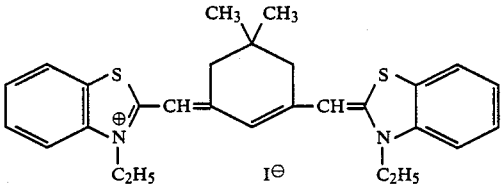

($1.0 \times 10^{-4}$ mol per mol of silver halide)

As irradiation preventing dyes for each emulsion layer, the following dyes were used.

For the Green-Sensitive Emulsion Layer:

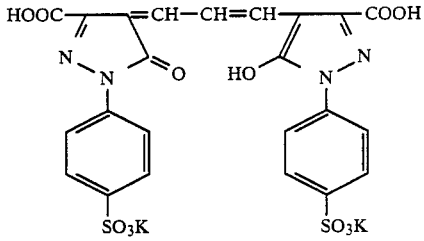

For the Red-Sensitive Emulsion Layer:

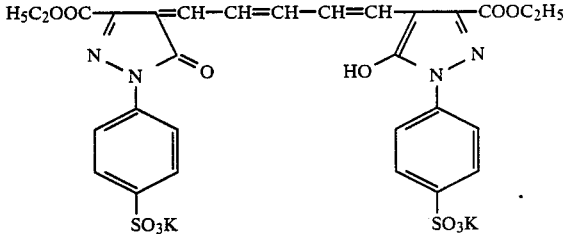

The compounds (couplers, etc.) used in the example were as follows:

Yellow Coupler (a):

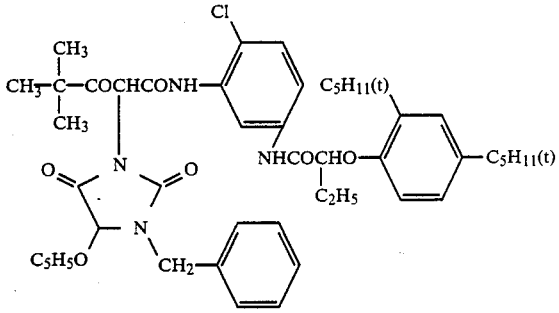

Color Image Stabilizer (b):

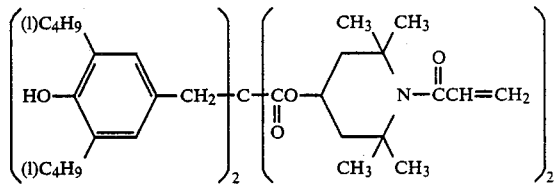

Solvent (c):

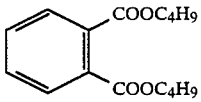

Color Mixing Preventing Agent (d):

-continued

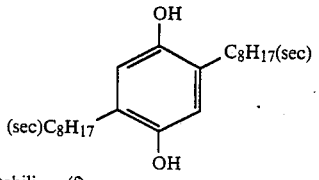

Color Image Stabilizer (f):

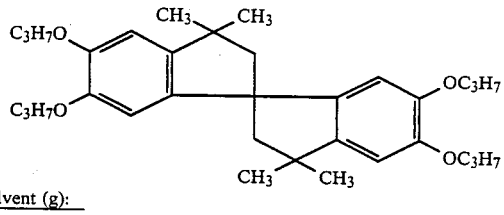

Solvent (g):

$(C_8H_{17}O)_3P{=}O$, and

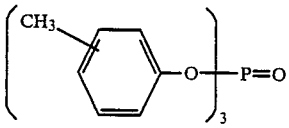

A mixture thereof at 2/1 (weight ratio)

Ultraviolet Absorbent (h):

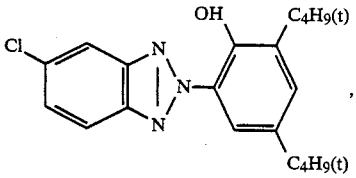

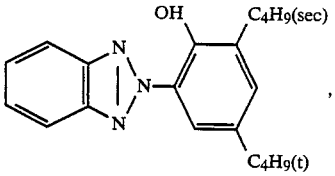

and

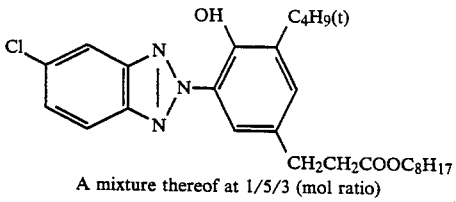

A mixture thereof at 1/5/3 (mol ratio)

Color Mixing Preventing Agent (i):

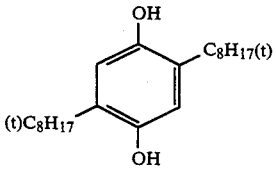

Solvent (j):

-continued $(\text{iso } C_8H_{17}O)_3P{=}O$

Cyan Coupler (k):

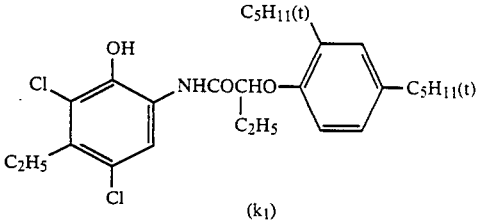

$(k_1)$ and

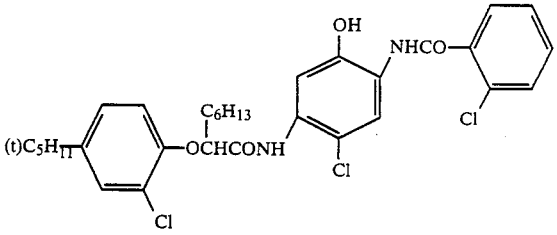

$(k_2)$

A mixture thereof at 1/1 (mol ratio)

Color Image Stabilizer (l):

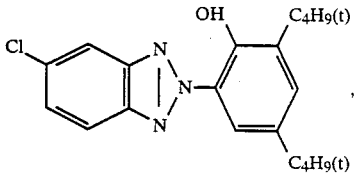

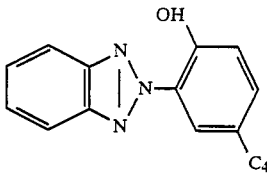

and

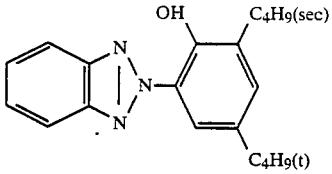

A mixture thereof at 1/3/3 (mol ratio)

Solvent (m):

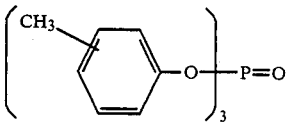

Also, the magenta couplers used for the above samples were as follows.

For Sample (A):

-continued

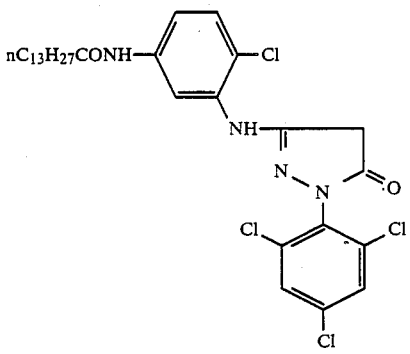

For Sample (B):

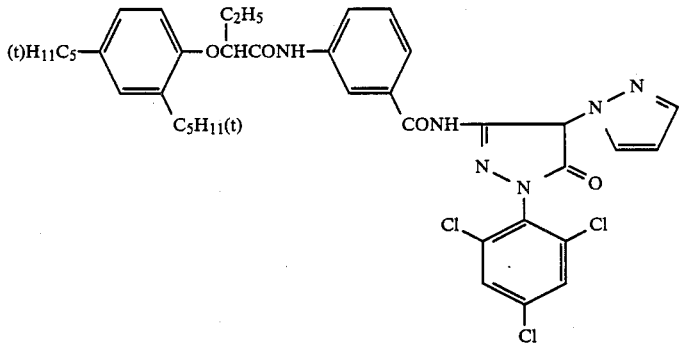

For Sample (C):

Compound (M-53)

For Sample (D):

Compound (M-55)

For Sample (E):

Compound (M-57)

Then, by following the same procedure as above except that an ethanol solution of Compound I-23 was contained in the coating composition for each green-sensitive emulsion layer of each of Samples (A) to (E) described above in an amount (content of I-23) of 30 mg/m$^2$, the samples of this invention (Samples (A)' to (E)') were prepared.

Each of the samples thus prepared was subjected to stepwise exposure for sensitometry through each of a blue filter, green filter, and red filter, using a sensitometer (FWH type, manufactured by Fuji Photo Film Co., Ltd., color temperature of light source: 3,200° K.). In this case, the light exposure was performed to give an exposure amount of 250 CMS at an exposure time of 0.5 sec.

Each of the samples thus exposed was processed by the following processing steps.

| Processing Step | Temperature (°C.) | Time |
|---|---|---|
| Color Development | 38 | 2 min 00 sec |
| Blixing (bleach-fixing) | 33 | 1 min 00 sec |
| Washing in Water | 24–33 | 1 min 00 sec |
| Drying | 80 | 30 sec |

The compositions of the processing liquids used in the above processing steps were as follows.

In this case, Composition A containing benzyl alcohol and Composition B containing no benzyl alcohol were used as the color developer.

| | Composition A | Composition B |
|---|---|---|
| Color Developer: | | |
| Diethylenetriaminepentaacetic Acid | 2.0 g | 2.0 g |
| Benzyl Alcohol | 15 ml | — |
| Diethylene Glycol | 10 ml | — |
| Sodium Sulfite ($Na_2SO_3$) | 2.0 g | 2.0 g |
| Potassium Bromide (KBr) | 0.6 g | 0.6 g |
| Hydroxylamine Sulfate | 3.0 g | 3.0 g |
| 4-Amino-3-methyl-N—ethyl-N—[β-(methanesulfonamido)ethyl]-p-phenylenediamine Sulfate | 4.5 g | 4.5 g |
| Potassium Carbonate ($K_2CO_3$) | 30.0 g | 30.0 g |
| Water to make | 1 l | 1 l |
| pH | 10.25 | 10.25 |
| Blixing Solution: | | |
| Ammonium Thiosulfate (54 wt %) | 150 ml | |
| Sodium Sulfite ($Na_2SO_3$) | 15 g | |
| $NH_4$[Fe(III)(EDTA)] | 55 g | |
| EDTA.2Na | 4 g | |
| Water to make | 1 l | |
| pH | 6.9 | |

The maximum density of the magenta dye obtained was measured for each sample thus processed by means of a Macbeth densitometer and the results obtained are shown in Table 1 below.

TABLE 1

| Experiment No. | Sample No. | Maximum Density | |
|---|---|---|---|
| | | Composition A | Composition B |
| 1 | (A) | 2.35 | 1.85 |
| 2 | (B) | 2.40 | 1.90 |
| 3 | (C) | 2.45 | 1.88 |
| 4 | (D) | 2.45 | 1.80 |
| 5 | (E) | 2.40 | 1.90 |
| 6 | (A)' | 2.38 | 2.15 |
| 7 | (B)' | 2.42 | 2.18 |
| 8 | (C)' | 2.47 | 2.44 |
| 9 | (D)' | 2.45 | 2.43 |
| 10 | (E)' | 2.41 | 2.40 |

Samples (A) to (E): Comparative samples
Samples (A)' to (E)': Samples of this invention As is apparent from the results shown in Table 1 above, the samples of this invention (Samples (A)' to (E)'), containing Compound I-23 , showed an excellent coloring property even in the color development processing of short period of time without using benzyl alcohol, and further the cases of using the magenta coupler shown by formula (II) (Samples (C)' to (E)') showed almost the same coloring property in the color development processing without using benzyl alcohol as the case of using benzyl alcohol.

EXAMPLE 2

When the same procedure as the case of Example 1 was repeated except that Compound I-11 in place of Compound I-23 used in Example 1 was used, the samples of this invention showed an excellent coloring property even in the case of removing benzyl alcohol from the color developer as the results in Example 1.

EXAMPLE 3

Continuous color photographic processing was performed using Fuji Color Paper Type 12 (color photographic paper, made by Fuji Photo Film Co., Ltd.) by the following processing steps until the replenisher for the color developer was supplied to three times the volume of the color developer tank.

| Processing Step | Time |
|---|---|
| Color Development (38° C.) | 2 min 00 sec |
| Blix (33° C.) | 1 min 00 sec |
| Rinse 1 (30° C.) | 20 sec |
| Rinse 2 (30° C.) | 20 sec |
| Rinse 3 (30° C.) | 20 sec |

The rinse was performed in countercurrent washing from Rinse 3 to Rinse 1.

The compositions of the processing solutions used in the above processing steps were as follows.

| | Tank Liquid | Replenisher |
|---|---|---|
| Color Developer: | | |
| Diethylenetriaminepentaacetic Acid | 2.0 g | 2.0 g |
| Sodium Sulfite | 2.0 g | 2.0 g |
| Potassium Bromide | 0.5 g | 0 g |
| Potassium Carbonate | 30.0 g | 25.0 g |
| N—Ethyl-N—(β-methanesulfonamidoethyl-3-methyl-4-aminoaniline Sulfate | 4.5 g | 6.5 g |
| Hydroxylamine Sulfate | 4.0 g | 4.5 g |

-continued

| | Tank Liquid | Replenisher |
|---|---|---|
| Brightening Agent (stilbene series) | 1.0 g | 1.5 g |
| Water to make | 1 l | 1 l |
| pH | 10.25 | 10.65 |
| Water | 400 ml | 400 ml |
| Ammonium Thiosulfate (70 wt %) | 150 ml | 300 ml |
| Sodium Sulfate | 18 g | 36 g |
| Ammonium Ethylenediaminetetraacetic Acid Iron (III) | 55 g | 110 g |
| Ethylenediaminetetraacetic Acid | 5 g | 10 g |
| Water to make | 1 l | 1 l |
| pH | 6.75 | 6.30 |

The amounts of the replenishers for the color developer and the blixing solution were 160 ml and 60 ml, respectively, per square meter of the color paper.

Also, the rinse step was continuously performed using each of the following two steps.

Rinse Step (C):

Water only was replenished in an amount of 10 l/m$^2$.

Rinse Step (D):

Water containing 1.0 g/l of EDTA·2Na was replenished in an amount of 200 ml/m$^2$.

In this case, the amount of the liquid carried by the color papers from the previous bath was 50 ml/m$^2$.

By using the solutions after performing the two kinds of the continuous processings, light-exposed Samples (C) and (C)' obtained as in Example 1 were processed. Each sample thus processed was irradiated by xenon lamp of 85,000 lux for 10 days and the residual density of magenta dye at the initial density of 2.0 was measured. The results obtained are shown in Table 2.

TABLE 2

| Sample | Rinse Step (C) | Rinse Step (D) |
|---|---|---|
| Sample (C) | 1.81 | 1.53 |
| Sample (C)' | 1.82 | 1.80 |

Sample (C): Comparative sample
Sample (C)': Sample of this invention.

From the results shown in Table 2 above, it can be seen that the sample of this invention (Sample (C)') showed almost no increase in light fading of magenta dye even when the amount of the replenisher for washing (rinse) is greatly reduced (Rinse Step (D)).

EXAMPLE 4

After following the same continuous processing as in Example 3 using each of the following Rinse Steps (E) to (H) in place of Rinse Step (D), light-exposed Samples (C) and (C)' as in Example 1 were processed. When the light fading of magenta dye was measured on each sample as in Example 3, it was confirmed that the occurrence of light fading of magenta dye was also prevented in the sample of this invention.

Rinse Step (E):

Water containing 1 g/l of 1,2,3-benzotriazole was replenished in an amount of 200 ml/m$^2$.

Rinse Step (F):

Water containing 100 mg/l of sulfanylamide was replenished in an amount of 200 ml/m$^2$.

Rinse Step (G):

Water containing 30 mg/l of 5-chloro-2-methyl-4-isothiazolin-3-one was replenished in an amount of 200 mg/l.

| Rinse Step (H): | |
|---|---|
| 1-Hydroxyethylidene-1,1-diphosphonic Acid (60 wt %) | 2.0 ml |
| Bismuth Chloride ($BiCl_2$) | 1.0 g |
| Ammonium Hydroxide (28 wt %) | 1.8 ml |
| 5-Chloro-2-methyl-4-isothiazolin-3-one | 30 mg |
| Water to make | 1 l |
| pH | 7.0 |

The solution having the above composition was replenished in an amount of 250 ml/m$^2$.

As described above, according to this invention, color photographic materials can be processed substantially without using benzyl alcohol, whereby the problems of environmental pollution can be greatly reduced, the work for preparing the color developer can be reduced, and also the reduction in density caused by the cyan dyes remaining in leuco compounds can be avoided. Furthermore, according to the process of this invention, a large number of color prints can be quickly processed to greatly improve the productivity of color prints. Also, according to this invention, when color photographic materials are processed using a color developer substantially free from benzyl alcohol in a short period of time, color prints having sufficiently less reduction of color density can be obtained. Still further, in the process of this invention, even when the amount of the replenisher for the wash step is greatly reduced, the occurrence of light fading of magenta dye images can be prevented regardless of the kind of additive(s) used for the wash water.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material, which comprises processing by treatment with a color developer containing an aromatic primary amine development agent and less than 0.5 ml/l of benzyl alcohol, for a time shorter than 2 min and 30 sec, said process further comprising a washing with a washing solution or a stabilizing with a stabilization solution, wherein water saving is accomplished by using a replenishing amount of the wash solution or the stabilization solution in an amount from 3 to 30 times the amount of solution carried into the wash solution used for the washing or the stabilization solution used for the stabilization from a bath prior thereto in the process, a silver halide color photographic material having on a support at least one photograph-constituting layer containing a compound represented by formula (I)

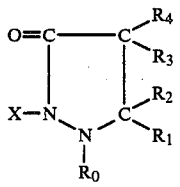

(I)

wherein $R_0$ represents a substituted or unsubstituted aryl group; $R_1$, $R_2$, $R_3$ and $R_4$ each represents a hydrogen atom, a substituted or unsubstituted alkyl group, or a substituted or unsubstituted acetyl group; and X represents a hydrogen atom or a substituted or unsubstituted acetyl group.

2. A process as in claim 1, wherein the support is a reflective support.

3. A process as in claim 1, wherein the silver halide color photographic material has at least one blue-sensitive emulsion layer, at least one greensensitive emulsion layer, and at least one red-sensitive emulsion layer and at least one of the emulsion layers contains the compound of formula (I).

4. A process as in claim 1, wherein the amount of the compound of formula (I) in the photograph-constituting layer is from 0.001 mol to 1.0 mol per mol of the silver halide in the emulsion layer.

5. A process as in claim 1, wherein the aromatic primary amine developing agent is a p-phenylenediamine derivative.

6. A process as in claim 1, wherein the aromatic primary amine developing agent is 4-amino-3-methyl-N-ethyl-N-[β-(methanesulfonamido)ethyl]-p-phenylenediamine salt.

7. A process as in claim 1, wherein the color developer is used at a pH of from 9 to 12.

8. A process as in claim 1, wherein the color developer is used as a pH of from 9 to 11.

9. A process as in claim 1, wherein a silver halide emulsion contained in the silver halide color photographic material forms upon exposure to light, a latent image predominantly on the surface of the silver halide grains.

10. A process as in claim 1, wherein the silver halide color photographic material further contains a magenta coupler represented by formula (II),

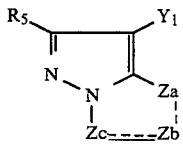

(II)

wherein $R_5$ represents a hydrogen atom or a substituent; $Y_1$ represents a group capable of being released by a coupling reaction with the oxidation product of an aromatic primary amine developing agent; and Za, Zb and Zc each represents a substituted or unsubstituted methine group, =N—, or —N—; at least one of the Za—Zb bond and the Zb—Zc bond being a double bond and the other being a single bond.

11. A process as in claim 10, wherein the magenta coupler of formula (II) is present in the silver halide emulsion layer in an amount of from $2\times10^{-3}$ mol to $5\times10^{-1}$ mol per mol of silver in the emulsion layer.

12. A process as in claim 10, wherein the silver halide color photographic material containing the magenta coupler of formula (II) is a silver halide emulsion layer.

13. A process as in claim 3, wherein the amount of the compound of formula (I) in the emulsion layer is from 0.001 mol to 1 mol per mol of the silver halide in the emulsion layer.

14. A process as in claim 13, wherein the magenta coupler is represented by formula (V) or (VI) wherein at least one of $R_6$ and $R_7$ is a branched substituted or unsubstituted alkyl group that is an alkyl group or a substituted alkyl group which is connected to a pyrazoloazole skeleton through a secondary or tertiary carbon atom.

15. A process as in claim 14, wherein the secondary or tertiary carbon atom has at least two group selected from an alkyl group or a substituted alkyl group.

16. A process as in claim 15, wherein the secondary or tertiary carbon atom has at least one of a sulfonamido alkyl group, a sulfonamidoaryl alkyl group, or a sulfonylalkyl group.

17. A process as in claim 10, wherein magenta coupler is represented by formula (V) or (VI):

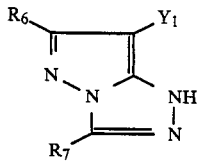

(V)

-continued

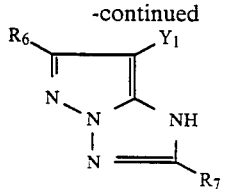

(VI)

wherein $R_6$ and $R_7$ each represents a hydrogen atom, a halogen atom, an alkyl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and $Y_1$ represents a hydrogen atom, a halogen atom, a carboxy group, or a coupling releasable group capable of being released upon coupling by being bonded-with the carbon atom at the coupling position of a coupler through an oxygen atom, a nitrogen atom, or a sulfur atom.

18. A process as in claim 1, where replenishment is for the wash solution.

19. A process as in claim 1, where replenishment is for the stabilization solution.

* * * * *